US005649574A

United States Patent [19]

Turcotte et al.

[11] Patent Number: 5,649,574

[45] Date of Patent: Jul. 22, 1997

[54] ENGINE COOLANT REMOVAL AND REFILL METHOD AND DEVICE

[75] Inventors: David E. Turcotte, Woodhaven; John J. Conville, Canton; Stephen M. Zeld, Wyandotte; Daniel E. Coker, Gross Ille; James T. Lyon, Novi, all of Mich.

[73] Assignee: Ashland, Inc., Lexington, Ky.

[21] Appl. No.: 639,829

[22] Filed: Apr. 29, 1996

Related U.S. Application Data

[63] Continuation of Ser. No. 97,479, Jul. 27, 1993, Pat. No. 5,511,590.

[51] Int. Cl.[6] ..... B65B 13/00

[52] U.S. Cl. ..... 141/67; 141/59; 141/65; 141/92; 141/98; 134/169 A; 165/95

[58] Field of Search ..... 141/1, 5, 7, 59, 141/61, 65, 67, 92, 98; 134/169 A; 165/95; 184/1.5; 220/DIG. 32; 73/45.8

[56] References Cited

U.S. PATENT DOCUMENTS

| | | | |
|---|---|---|---|
| 3,034,521 | 5/1962 | Greenfield | 220/DIG. 32 |
| 4,079,855 | 3/1978 | Avrea . | |
| 4,390,049 | 6/1983 | Cassia . | |
| 4,634,017 | 1/1987 | Kilayko | 220/DIG. 32 |
| 4,679,424 | 7/1987 | Tubman | 220/DIG. 32 |
| 4,708,175 | 11/1987 | Janashak et al. | 141/1 |
| 4,809,542 | 3/1989 | Jones | 220/DIG. 32 |
| 4,809,769 | 3/1989 | Vataru . | |
| 4,888,980 | 12/1989 | DeRome | 73/49.2 |
| 4,911,211 | 3/1990 | Anderson | 141/7 |
| 4,949,765 | 8/1990 | Creeron | 141/7 |
| 5,069,062 | 12/1991 | Malacek et al. | 73/45.8 X |
| 5,103,878 | 4/1992 | Cassia | 141/65 |

*Primary Examiner*—J. Casimer Jacyna

*Attorney, Agent, or Firm*—Middleton & Reutilinger; David W. Carrithers

[57] ABSTRACT

A removal and refill apparatus for use in removing and/or refilling coolant in an automotive cooling system. The automotive cooling system typically includes a radiator, overflow bottle, engine, water pump, and heater core elements. A method for utilizing the coolant removal and refill apparatus utilizing vacuum and pressure is described for use with the removal and refill apparatus.

15 Claims, 17 Drawing Sheets

(PRIOR ART)

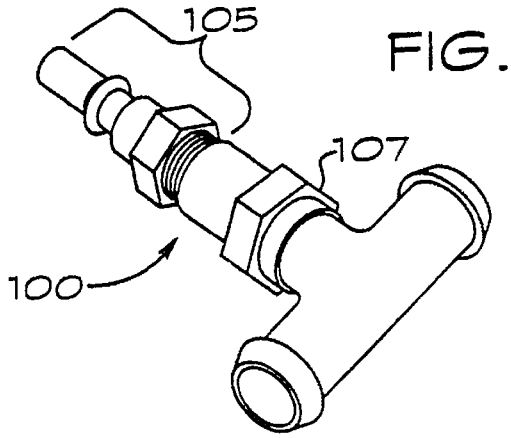
FIG. 3A
FIG. 3B
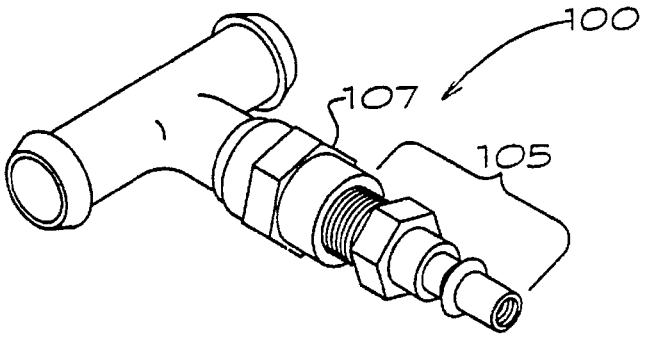
FIG. 3C
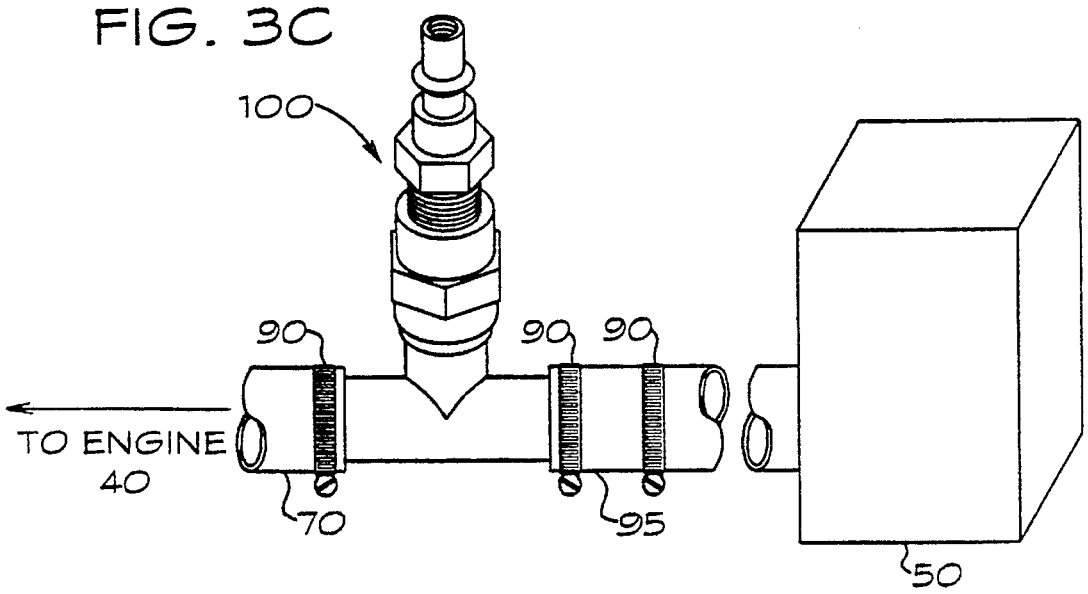

ENGINE COOLANT REMOVAL AND REFILL METHOD AND DEVICE

This application is a continuation of U.S. patent application Ser. No. 08/097,479, filed Jul. 27, 1993, now U.S. Pat. 5,511,590 which issued on Apr. 30, 1996.

FIELD OF THE INVENTION

The present invention relates to a rapid and efficient method of removing antifreeze/coolant from automotive cooling systems, as well as to a method for refilling the cooling system. The invention also relates to certain devices which will facilitate the above processes.

BACKGROUND OF THE INVENTION

Antifreeze or coolant which is utilized in automotive vehicles requires periodic flushing and refilling with fresh coolant to prevent overheating of vital engine parts. An automotive engine may conceptually be divided into two parts, typically with the engine and heater core on one lateral side, and the radiator and overflow bottle on the other. Substantially complete removal of antifreeze coolant would thus necessitate flushing all four of the above components.

Typically, automotive coolant removal is done annually or more or less often by vehicle owners or automotive professionals. In most instances, completely draining the cooling system of spent antifreeze can be a time-consuming and elusive undertaking. Moreover, the flushed antifreeze may be considered a hazardous substance by the Environmental Protection Agency (EPA) and therefore must be disposed of with care. It is thus in the consumer's and the environment's best interest to create as little of the waste coolant product as possible.

Many methods have been devised to facilitate the removal of antifreeze from the cooling system. One way is to simply allow the coolant to drain from the bottom of the radiator. This is referred to as gravity draining, and by itself can be a rather tedious and inefficient process. If the radiator and overflow bottle components are vertically higher than the engine and heater core elements, then coolant from the latter two can not be effectively removed.

Another way to flush antifreeze from the engine is to remove the cap on the top of the radiator and apply water through the system using a garden hose or the like. This method can often facilitate the coolant removal, but unfortunately what starts out as one concentrated gallon of potential environmental contaminants is multiplied into twenty dilute gallons. This process can also be very messy.

By using a standard flush "T" device it is also possible to remove the coolant from the system via the heater hose line connecting the heater core and the engine. One or more clamps in the line are loosened and the "T" is then inserted therein. The "T" has a cap covering a male connection. The cap can be removed and the female end of a water hose is then connected to the "T". Water from an outside source moves through the "T" and flushes antifreeze from the engine components. While this mechanism can help to remove coolant from the engine and heater core components, it is not fully efficient and also has the environmental drawbacks associated with utilizing water for flushing.

Those skilled in the art have devised other methods and apparatus to address the coolant removal problem from automotive vehicles.

Kilayko, U.S. Pat. No. 4,634,017, relates to a flushing connection which attaches to the radiator for use with a pressurized water source. This device may not allow complete removal of spent antifreeze if the radiator is higher than the engine. The method of the '017 patent may also produce many gallons of toxic chemical waste.

Vataru et al., U.S. Pat. No. 4,809,769, involves a method to remove coolant from an engine using gas pressure, treatment of the coolant external to the engine and reintroduction of the coolant to the engine under pressure of gas. Unfortunately, this process involves pressurizing at the low point of the system, and therefore involves working against gravity- Moreover, there is also the requirement that a tube or straw be inserted in the radiator for forcing coolant throughout the system.

In Creeron, U.S. Pat. No. 5,090,458, a flush/fill a pumping device. An elongated tube as part of the radiator cap extends well into the radiator, and the pumping device removes spent coolant via the tube. New liquid may be introduced into the radiator also through the elongated tubular member. This device may not work well with pressurized overflow battles since such system typically do not have radiator openings or overflow bottles large enough to accommodate the device.

There presently exists a need in the art for a more efficient and versatile method of removing antifreeze from automotive systems. The method must be environmentally friendly, as well as adaptable to a wide range of automotive cooling systems. Also needed are devices which facilitate the above processes, which are both simple in design and easy to operate. As with any draining procedure, it should work on hot and cold engines, and preferably without cutting any hoses, especially the heater hose.

Once spent coolant is removed from the engine cooling system, a method to refill the system quickly and efficiently is also needed. The cooling system must be efficiently filled to reduce or eliminate air pockets. Air pockets can impair cabin heat flow, damage water pump seals and in the worst case, cause engine damage by overheating. The approach must be generally applicable to all vehicles, especially modern vehicles with pressurized overflow bottles. Refill attachments should also avoid complex mechanical connections.

OBJECTS OF THE INVENTION

It is therefore an object of the present invention to provide a relatively tidy and efficient process for the removal of spent antifreeze from automotive cooling systems.

Another object of the invention is to provide a method for the rapid refilling of the cooling system with new or recycled antifreeze, or antifreeze/water mixtures.

An additional object of the invention is to provide methods of removal and refilling of automotive coolant which are adaptable to a wide range of vehicles.

A further object of the invention is to provide novel devices which are relatively simple in design and flexible in operation, and which can be used with the above processes of removal and refilling of coolant.

Also an object is providing antifreeze removal and refill devices which do not require cumbersome, bulky probes and poles, etc. extending deep into the interior of vulnerable cooling system members, such as radiators and pressurized overflow bottles.

Another object is to have antifreeze removal and refill devices and methods which are adaptable to pressurized overflow bottles, wherein access to the radiator is greatly restricted.

Another object is to provide a system of antifreeze removal and refill which does not create excessive waste which is unsafe for the environment.

Still another object of the present invention is to provide methods to verify cooling system integrity and establish the presence of any leaks.

SUMMARY OF THE INVENTION

These and other objects of the invention are achieved by providing an efficient method for the draining of antifreeze from an automotive cooling system having 1) radiator, 2) overflow bottle, 3) engine and 4) heater core members. (These members will also include all hoses, attachments and connections). The method involves applying air pressure at the "highest vertical point", hereinafter described, from amongst the four cooling system members.

As that term is used herein, "highest vertical point" refers to the highest practical site as measured from the ground up where air pressure maybe applied to one of the four aforementioned members of cooling system. The "highest vertical point" will be found on one of the four cooling system members, but those skilled in the art will recognize that the "highest vertical point" may not be the true highest point of the four aforementioned cooling system members.

As that term is used herein, the "lowest vertical point" will be the most downward point at which spent antifreeze can safely exit the cooling system. The "lowest vertical point" will be found on one of the four aforementioned cooling system members. The "lowest vertical point" may not be the true lowest point amongst the radiator, overflow bottle, engine and heater core members making up the cooling system. Moreover, the "highest vertical point" and the "lowest vertical point", respectively, may differ in different automotive cooling systems.

One or more coolant removal attachment elements, included as part of the invention to be attached to the highest vertical point, will facilitate the application of air pressure from an outside source throughout the cooling system during the coolant removal process. The air pressure will move the coolant downward throughout the four members of the cooling system. Draining of the used coolant via the lowest vertical point among the cooling system members will take place as air pressure is applied. Application of air pressure via the coolant removal attachment element may be done following simple, gravity draining of spent antifreeze. Application of air pressure via the coolant removal attachment element may also be effected without gravity draining.

Also provided as part of the invention is a rapid method for refilling the cooling system with fresh or recycled antifreeze, preferably via the radiator or overflow bottle. This process would involve utilizing one or more coolant refill elements. The coolant refill element preferably would comprise a two—way valve construction, and would most preferably attach to the radiator. A vacuum would be applied to the substantially drained cooling system via a vacuum prong of the two-way refill valve, and then antifreeze would be added throughout the system via a second, or coolant prong, of the two-way refill valve. In one embodiment of the invention, vacuum and refill can take place at substantially the same time. In the various embodiments, the vacuum applied is in the range of about 5–30 inches Hg, more preferably 10–25 inches Hg. As those skilled in the art will recognize, these vacuum numerical values may of course vary somewhat.

BRIEF DESCRIPTION OF THE DRAWINGS

FIGS. 3A and 3B are plan views of a coolant removal attachment element according to one embodiment of the invention.

FIG. 3C is a view of the coolant removal attachment element of FIGS. 3A and 3B installed in a standard heater hose line.

FIG. 10B1 is a cross-sectional view of a tube-in-tube design.

FIG. 10B2 is a cross-sectional view of a side-by-side tube design.

DETAILED DESCRIPTION OF THE PREFERRED EMBODIMENTS

Figure 1A:
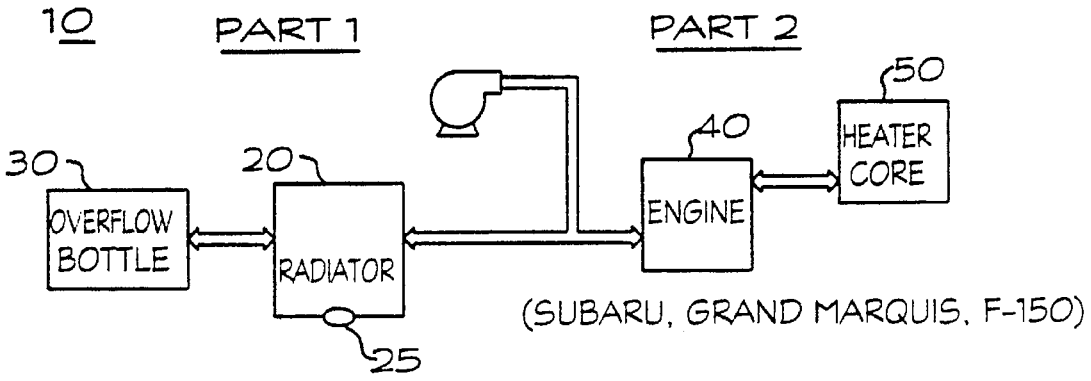
FIGS. 1A, 1B and 1C are two-dimensional diagrammatic representations of various automotive cooling systems.
Figure 1B:
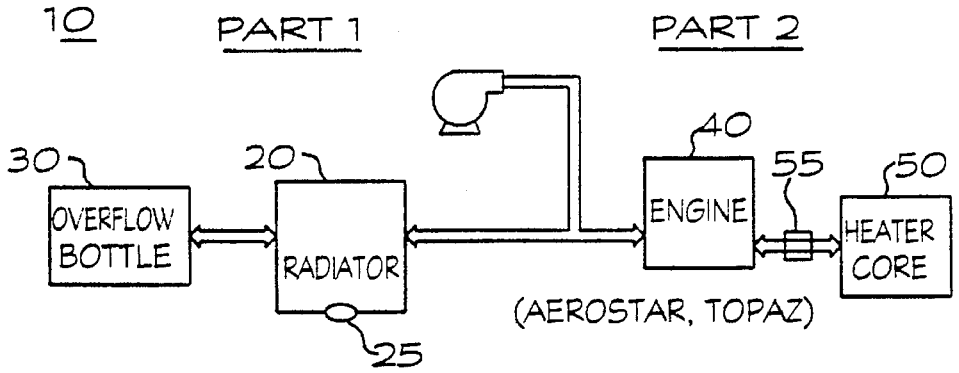
Figure 1C:
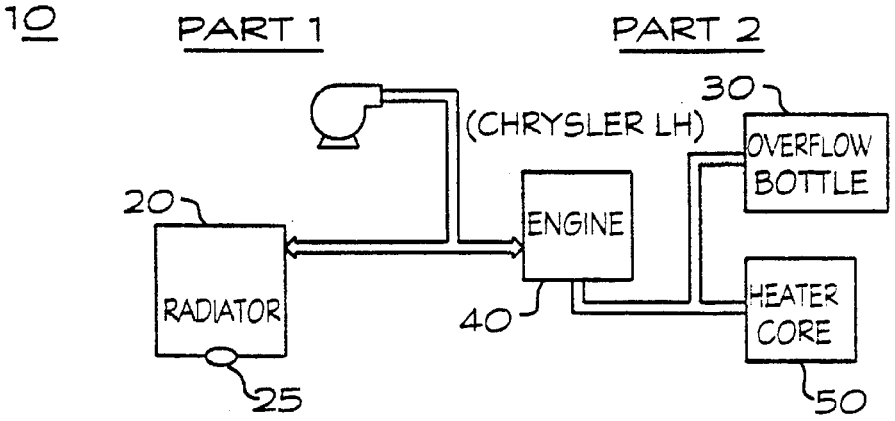

Referring now to the drawings in which like numerals indicate like components throughout the various embodiments, FIGS. 1A, 1B and 1C are two-dimensional diagrams of an automotive cooling system 10. As shown in FIGS. 1A, 1B and 1C the vehicle cooling system 10 may conceptually be divided into two parts—Part 1 and Part 2. Part 1 in FIGS. 1A and 1B consists of the radiator 20 (with draincock 25) and the overflow bottle 30. The radiator 20 maybe any automotive vehicle radiator presently known in the art. The overflow bottle 30 maybe any of the non-pressurized or newer pressurized versions found in the art. Part 1 in FIG. 1C consists of the radiator 20, while the overflow bottle 30 is in Part 2, hereinafter described.

Part 1 in turn is laterally separated from Part 2 by a thermostat or water pump. Part 2 includes the engine 40 and heater core 50 members of the types known in the art. Both the design and function of the radiator 20, overflow bottle 30, engine 40 and heater core 50 members are well known in the art. One requirement is that antifreeze from the radiator 20 and the overflow bottle 30 circulate throughout the engine 40 and heater core 50 to prevent overheating.

As FIG. 1A shows, the heater core member 50 of Part 2 is vertically higher than both the overflow battle 30 and radiator 20 members of Part 1. In other words, the heater core member 50 is farther from the ground than is the overflow battle 30 or radiator 20. In FIG. 1A the heater core 50 thus represents the "highest vertical point", while the radiator 20 represents the "lowest vertical point".

In FIG. 1B, the opposite situation is shown. The radiator 20 or the overflow battle 30 is vertically higher than both the heater core 40 or engine 50 members of Part 2. Conversely, in FIG. 1B, the heater core 50 or engine 40 members are closer to the ground. FIG. 1B also shows drain point 55 which may be the heater hose connection to the heater core, or a flush "T" thereinafter described. Drain point 55 thus represents the "lowest vertical point" in the cooling system exemplified in FIG. 1B.

In FIG. 1C, the overflow bottle 30 is in Part 2 with the heater core 50 and engine 40. The Chrysler LH cars typify this new cooling system design. The overflow battle 30 is pressurized and is the "highest vertical point" in the system. The draincock 25 on the radiator 20 is considered the "lowest verticle point".

The pressurized overflow battle is now available on some late-model automotive vehicles. This type of overflow battle comes with a cap for refill, in lieu of a similar cap on the radiator. In this way, the presence of corrosive gases, such as oxygen, and other corrosive compounds are minimized inside the radiator. All overflow battles take up excessive antifreeze which the radiator's limited capacity cannot accommodate. Pressurized overflow battles allow for deaeration of the working coolant, in turn improving heat transfer and reducing corrosion. By virtue of their design, pressurized overflow battles restrict access to the radiator.

As will be shown herein, the antifreeze removal and refill procedures and apparatus according to the invention can be adapted to any of the automotive cooling systems 10 shown in FIGS. 1A, 1B and 1C. In addition, it is expected that the process of the invention will find utility in those automotive cooling systems (not shown in FIG. 1) wherein the engine may be higher than both of the radiator and overflow bottle. It should further be noted by those skilled in the art that the coolant removal and refill procedures and apparatus of the invention may also be adapted to other cooling system layouts not shown in FIGS. 1A, 1B and 1C. For example, there are automotive vehicles with no overflow bottles, as well as those with two heater cores.

Referring again to the diagram shown in FIG. 1A, the method of removing antifreeze from an automotive cooling system according to one embodiment of the invention involves the situation wherein the heater core 50 of Part 2 is vertically higher than the radiator 20 and overflow bottle 30 members of Part 1. To drain the cooling system of antifreeze, a novel coolant removal attachment element, hereinafter described, will be utilized.

Figure 2A:
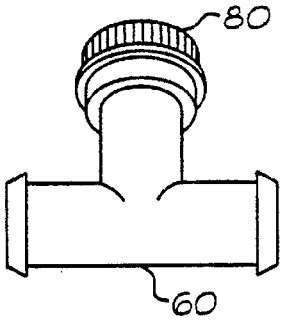
FIGS. 2A and 2B are plan views of a flush "T" device.
Figure 2B:
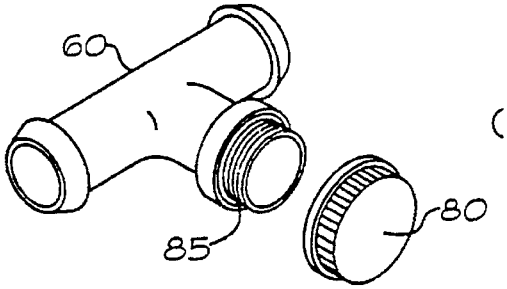
(PRIOR ART) FIG. 2B
Figure 2C:
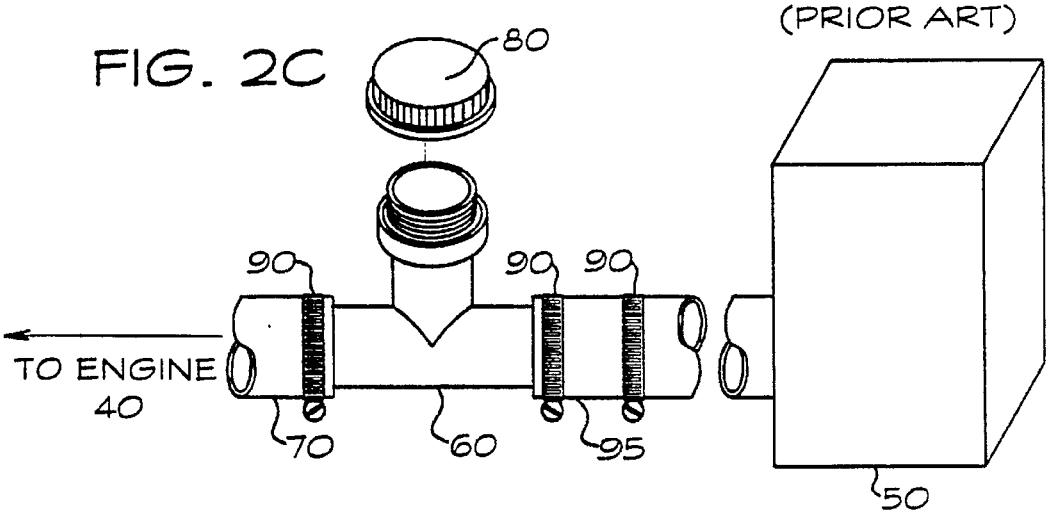
(PRIOR ART) FIG. 2C
FIG. 2C is a plan view of a flush "T" device installed in a standard heater hose line.

Referring now to FIGS. 2A, 2B and 2C, a flush "T" 60 as part of the present state of the art is shown. The flush "T" 60, as heretofore outlined, is inserted into the heater hose line 70 connecting the heater core 50 and engine 40 members of FIG. 1A. In FIG. 2A, a cap 80 covering a male connection 85 is secured to the flush "T", thereby preventing any leakage. In FIG. 2B, the cap 80 covering the male connection 85 is removed and a female water hose fitting (not shown) may be detachably affixed thereto. According to standard methods, water from an outside source such as a standard variety garden hose (not shown) would enter the cooling system through the water hose and through the male connection of the flush "T" 60. The water would flush spent antifreeze from the system. As previously set forth, this method can be messy and create several gallons of contaminated coolant waste.

Referring also to FIG. 2C, there is shown a two-dimensional view of a flush "T" 60 installed in a heater hose line 70 typically utilized in automotive vehicle cooling systems. The heater hose line 70 connects the heater core 50 and engine 40 components of the system. On either side of the flush "T" device are hose clamps 90. An optional extra length of hose 95 may also be installed between the flush "T" and the heater core. The optional hose 95 is secured to the heater core 50 by an extra hose clamp 90.

Referring now to FIGS. 3A, 3B and 3C, there are plan views of a coolant removal attachment element 100 according to one embodiment of the invention for use with the automotive cooling system 10 shown in FIG. 1A. The coolant removal attachment element 100 may be inserted into the heater hose line 70 connecting the heater core 50 and engine 40 members, and preferably is secured with clamps 90. An air line receiving element 105 maybe rigidly or removably mounted at the mounting end 107 of the coolant removal attachment element 100. The coolant removal attachment element 100 and air line receiving element 105 may be made of different or the same materials selected from any of the substantially durable materials known in the art. These may include, for example, molded plastic or other synthetic materials or metal or metal alloy(s) or possibly vulcanized rubber, or any combination thereof. Preferred is plastic or the yellow metals such as brass alloys, or ferrous metals, such as stainless steel.

The overall size and shape of the coolant removal attachment element 100 may vary somewhat. Those skilled in the art will find that the overall dimensions should be such as to permit its introduction into the heater hose line 70. Its size and shape should also permit the air line receiving element 105 to be fairly easily connected to an air line (not shown in FIGS. 3) from an outside air source, thus facilitating the coolant removal process. The size and shape of the coolant removal attachment element 100 should also be such that the element will not damage other internal engine components, or interfere with their operation.

In a preferred embodiment of the invention, the air line receiving element 105 of the coolant removal attachment element 100 is preferably detachable therefrom. It is also within the scope of the invention that the air line receiving element be rigidly fixed to the coolant removal element. The shape of the air line receiving element should be that which will facilitate connection to an air hose or other similar device. Preferred is the distal tapering as shown in FIGS. 3A, 3B and 3C. The length of the air line receiving element should desirably be within the range of about ½–4". The air line receiving element 105 is constructed so that air can pass through the coolant removal attachment element 100, and into the cooling system.

Referring also to FIG. 3C, there is shown the heater hose assembly of FIG. 2C. In FIG. 3C the flush "T" 60 has been removed by removing the hose clamps 90 on either side. The coolant removal attachment element 100 has been inserted in the heater hose line and secured with the hose clamps 90. In this way, those skilled in the art will find that cutting of the heater hose is unnecessary. In those embodiments of FIG. 2C wherein a flush "T" and one or more hose clamps have not been provided, it is also within the scope of the invention to simply cut the heater hose line, and install the coolant removal attachment element as shown in FIG. 3C, with or without the optional extra length of hose.

The coolant removal attachment element 100 of FIGS. 3A, 3B and 3C may be used in a coolant removal process in conjunction with the automotive cooling system 10 set forth in FIG. 1A. To drain the system of coolant, it is preferred that the drain point at the bottom of the radiator be first opened by removing the draincock 25 (shown in FIG. 1A). This action will serve two purposes. It will permit gravity draining of some of the fluid present in the radiator and the overflow bottle. Secondly, it will provide a release point for any built-up pressure in the cooling system. This built-up pressure may be internal, or may be the result of an external force, such as outside air pressure. In any event, the draincock to the radiator should be opened prior to the application of any outside air pressure, hereinafter described, to the system.

Figure 4A:
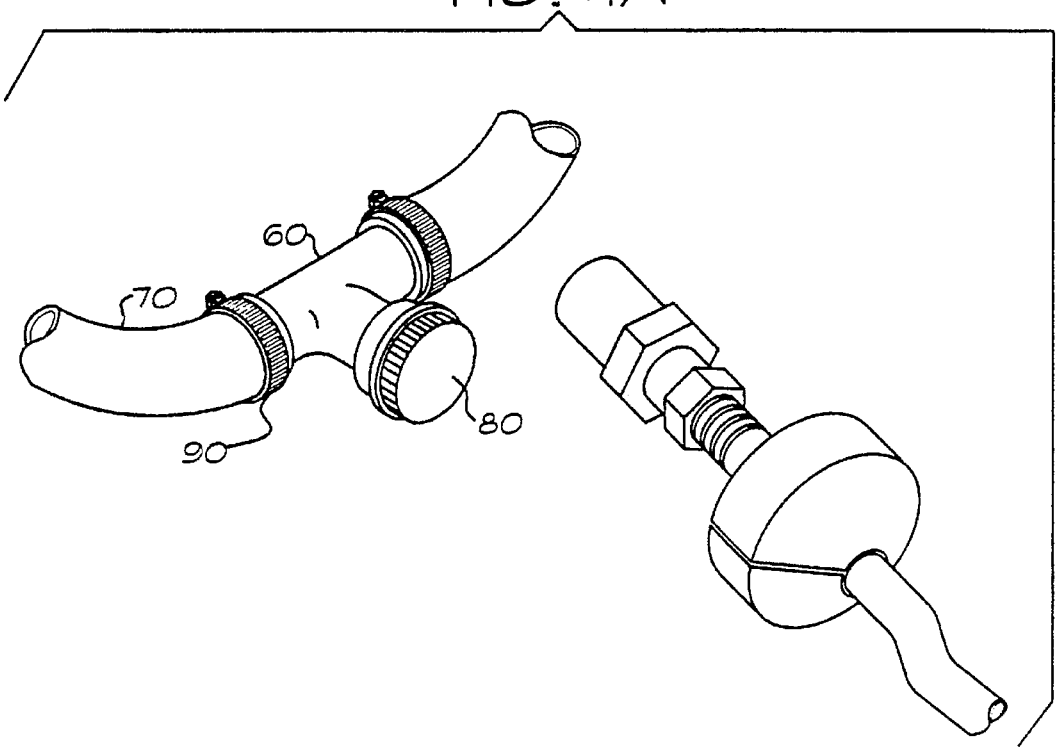
FIGS. 4A, 4B and 4C are plan views of the coolant removal attachment element of FIGS. 3A and 3B in conjunction with a standard heater hose line and air pressure apparatus.
Figure 4B:
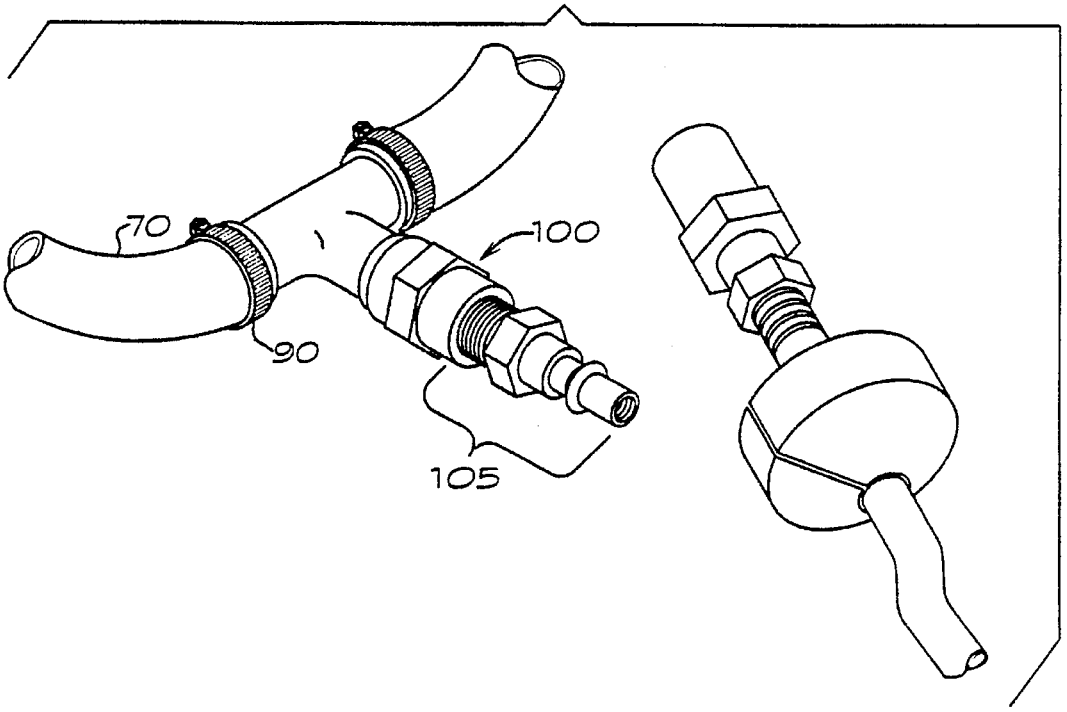
Figure 4C:
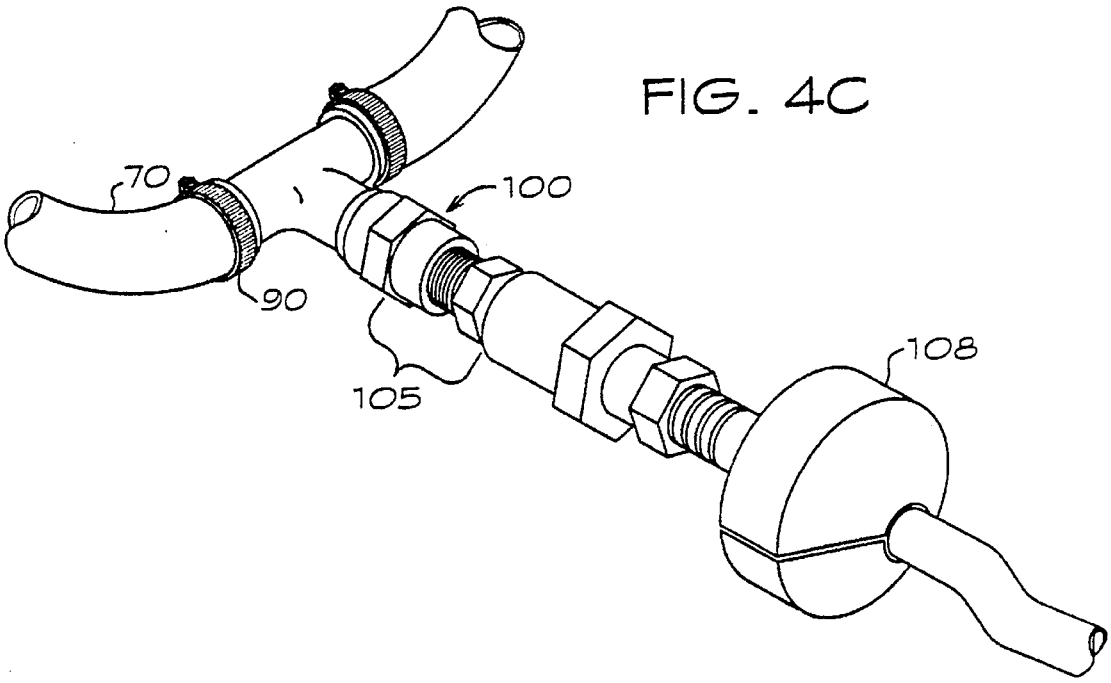

Referring now to FIGS. 4A, 4B, and 4C, there is shown the coolant removal attachment element 100 of FIGS. 3A, 3B and 3C in conjunction with a heater hose line 70 of an automotive cooling system. Once the draincock 25 at the bottom of the radiator 20 in FIG. 1A is opened or released ("lowest vertical point"), air pressure, as hereinafter described, will be applied to the heater hose line 70 ("highest vertical point") connecting the heater core and engine members from the outside air source. FIG. 4A shows a flush "T" 60 which has previously been inserted in the line and retained by clamps 90 on either side. The cap 80 on the flush "T" is in a secure position to prevent leakage.

In FIG. 4B, the flush "T" 60 has been converted to a coolant removal attachment element 100. FIG. 4B shows the air line receiving element 105 tapering slightly towards its distal end. The air line receiving element 105 will then be connected to the outside air pressure source (the air pressure source does not form part of the invention). It is also within the scope of the invention that the entire flush "T" 60 in FIG. 4A be removed, and replaced with a coolant removal connection element in FIG. 4B. In FIG. 4B the air line receiving element 105 is rigidly affixed to, and part of, the coolant removal attachment element 100.

In FIG. 4C, the air line receiving element 100 has been connected to the outside air pressure source 108 by handscrewing the air source over the air line receiving element. FIG. 4C thus shows the air line receiving element 105 mated with the outside air pressure source 108. Other means by which the air pressure source 108 is connected to the air line receiving element 105, other than or in addition to handscrewing, are also within the scope of the invention.

The outside air pressure source 108 may be any known to those skilled in the art. The air pressure to be applied to the cooling system may be pulsed or non-pulsed, but is preferably pulsed. The actual pressure of the air can vary, but should be high enough to facilitate drainage of the cooling system, and at the same time be low enough to prevent any damage to the system's internal components. It is desirable to utilize low pressure air in the range of about 15 p.s.i. or less, more preferably within the range of about 8 to 12 p.s.i., and even more preferably about 10 p.s.i. or less.

Once the outside air pressure source 108 is connected to the air line receiving element 105 of the coolant removal attachment element 100 in FIG. 4C, the outside air pressure source 108 is activated and low pressure air flows through the air line receiving element 100 and into the heater hose line 70 connecting the heater core and engine members ("highest vertical point"). It is thus this air pressure which will move the antifreeze through the engine, heater core, radiator and overflow bottle members downward through the cooling system for exit through the drain point 25 of the radiator 20 shown in FIG. 1A ("lowest vertical point"). The spent antifreeze can be collected in any suitable container. Once collected, the antifreeze may be disposed of, or can be recycled.

Once drainage of the used antifreeze is substantially complete, the outside air pressure source 108 is deactivated or turned off. The draincock 25 (in FIG. 1A) may then be secured to the bottom drain point of the radiator. The air line receiving element 105 may then be detached from the coolant removal attachment element 100, if not rigidly affixed thereto. A cap 80 is then securely placed over the space left by the removed air line receiving element 105 to keep the heater hose line 70 leak free. In another embodiment of the invention wherein the air line receiving element 105 is rigidly fixed to the coolant removal attachment element 100, then the entire coolant removal attachment element 100 may be removed from the heater hose line 70 and replaced with the closed flush "T" 60 (with cap 80) shown in FIG. 2A. It is also within the scope of the invention to remove the entire coolant removal attachment element 100 and simply reclamp the heater hose line 70 (clamps 90 shown in FIG. 2C).

The total time required for substantially complete drainage of the automotive cooling system utilizing the heretofore set forth methods and devices should typically be in the range of about 30 minutes or less. It is preferred that complete drainage take place within about 15 minutes or less. The time for drainage is measured from the time the coolant removal attachment element is connected to the automotive cooling system until the time that the continuous or pulsed application of air pressure results in a non-continuous flow of spent antifreeze, or merely drops, exiting the cooling system. Those skilled in the art may therefore discover that actual time for complete drainage will vary somewhat from the above times. Some factors which should be considered may include technician skill, shop layout and the particular vehicle being drained.

Figure 5A:
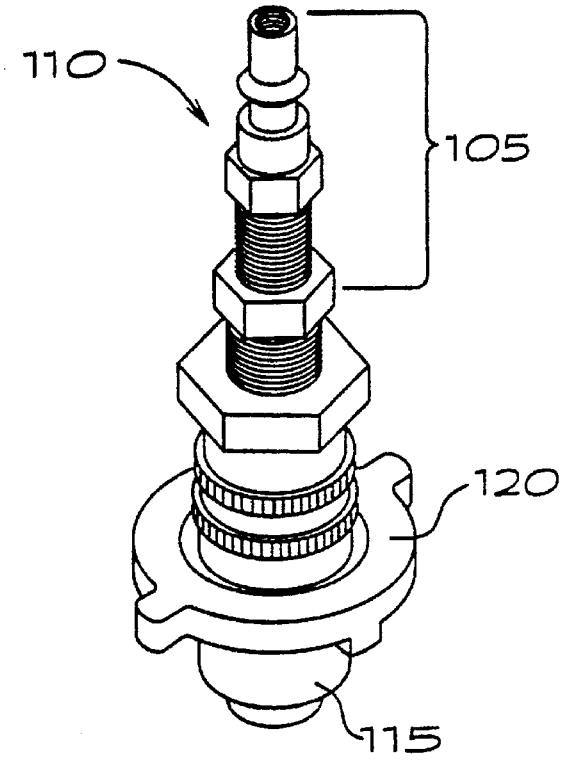
FIG. 5A is a plan view of a second coolant removal attachment element according to another embodiment of the invention.
Figure 5B:
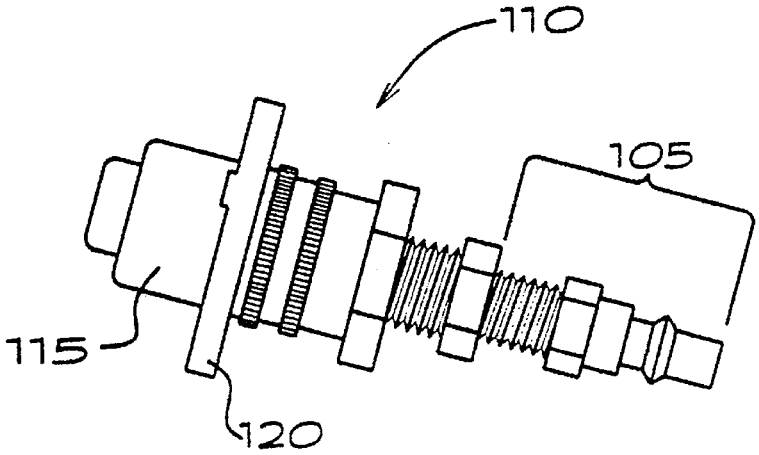
FIG. 5B is a side view of the coolant removal attachment element shown in FIG. 5A.

Referring now to FIGS. 5A and 5B, there is shown a second coolant removal attachment element 110 according to another embodiment of the invention. This device is to be used for draining antifreeze in conjunction with the vehicle cooling system 10 shown in FIG. 1B, wherein the radiator 20 and the overflow bottle 30 are vertically higher than both the engine 40 and the heater core 50. This coolant removal attachment element 110 is adapted to fit over a radiator neck in place of the radiator cap. (The coolant removal attachment element shown in FIGS. 5A and 5B may also be adaptable to the pressurized overflow bottles now available in some vehicles, hereinafter described.)

As shown in FIGS. 5A and 5B, the coolant removal attachment element 110 has two connection units 105 and 115, preferably at substantially opposite axial ends. The first connection unit 115 will seat inside the neck of a radiator. This is preferably accomplished by hand seating the first connection unit 115 into the radiator neck. The first connection unit 115 of the coolant removal attachment element 110 may also be circumferentially threaded on the exterior to facilitate its placement inside the radiator neck. It is preferred that the first connection unit be constructed of some durable, yet flexible material such as rubber for example. It is also preferred that the first connection not extend more than about an inch or so into the interior of the radiator. It is also within the scope of the invention that the first connection unit seat over the radiator neck, rather than inside.

Rigidly affixed to the first connection unit 115 is a cap component 120. The cap component 120 is designed to seat over a radiator neck opening. It is certainly within the scope of the invention to have the cap component 120 without the first connection unit 115, and vice versa. So long as one element secures the second coolant removal attachment element to the radiator neck opening, it is possible to eliminate the other element. It is more preferred to include the first connection unit 115 with the cap component 120. The overall dimensions of the cap component 120 will vary with the size of the radiator neck opening. The cap component should completely cover the radiator neck opening.

Also shown in FIGS. 5A and 5B is a second connection unit 105, or air line receiving element 105, as part of the second coolant removal attachment element 110. This air line receiving element 105 may be rigidly or detachably mounted to the cap component 120, but is preferably rigidly mounted. During the coolant removal process, this air line receiving element 105 is connected to an outside air pressure source (the outside air pressure source is not shown in FIGS. 5A and 5B, and does not form part of the invention).

The overall size and shape of the second coolant removal attachment element 110 may vary somewhat. Those skilled in the art will find that the overall dimensions should be such as to permit its adaptation to and use with the radiator. Its size and shape should also permit it to be fairly easily connected to an air line from an outside air source, thus facilitating the coolant removal process. The size and shape of the second coolant removal attachment element should also be such that the element will not damage other internal engine components, or interfere with their operation.

Like the first coolant removal attachment element 100, the second coolant removal attachment element 110 may also be constructed from any of the materials known in the art. These may include, for example, molded plastic or other synthetic materials or metal or metal alloy(s) or vulcanized rubber, or any combination thereof. Preferred is plastic or the yellow metals such as brass alloys, or ferrous metals, such as stainless steel. As heretofore stated, the first connection unit 115 of the second coolant removal connection element 110 is preferably made from rubber or similar material.

Figure 6A:
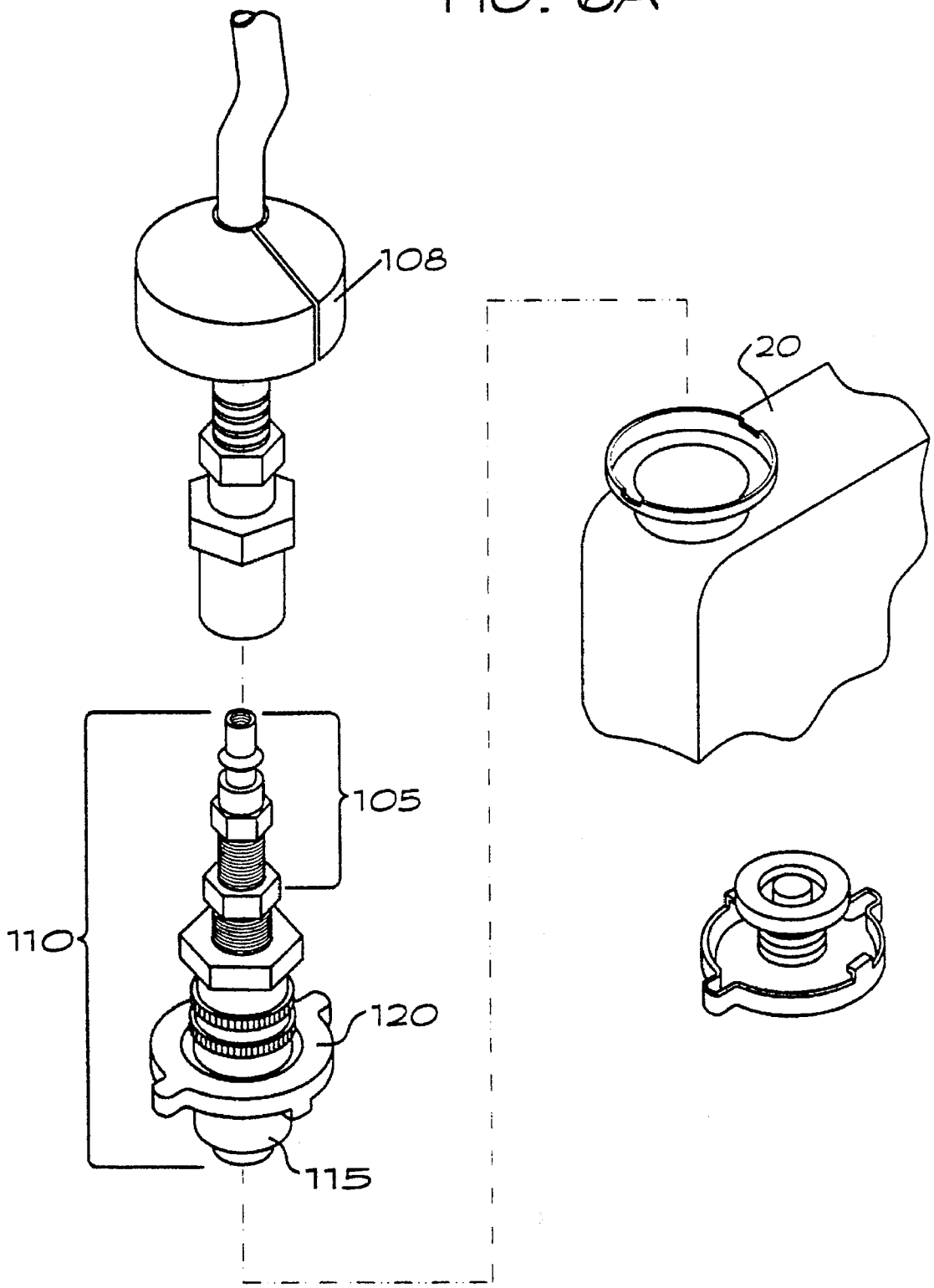
FIGS. 6A and 6B are plan views of the coolant removal attachment element Of FIGS. 5A and 5B in conjunction with a radiator and air pressure apparatus.
Figure 6B:
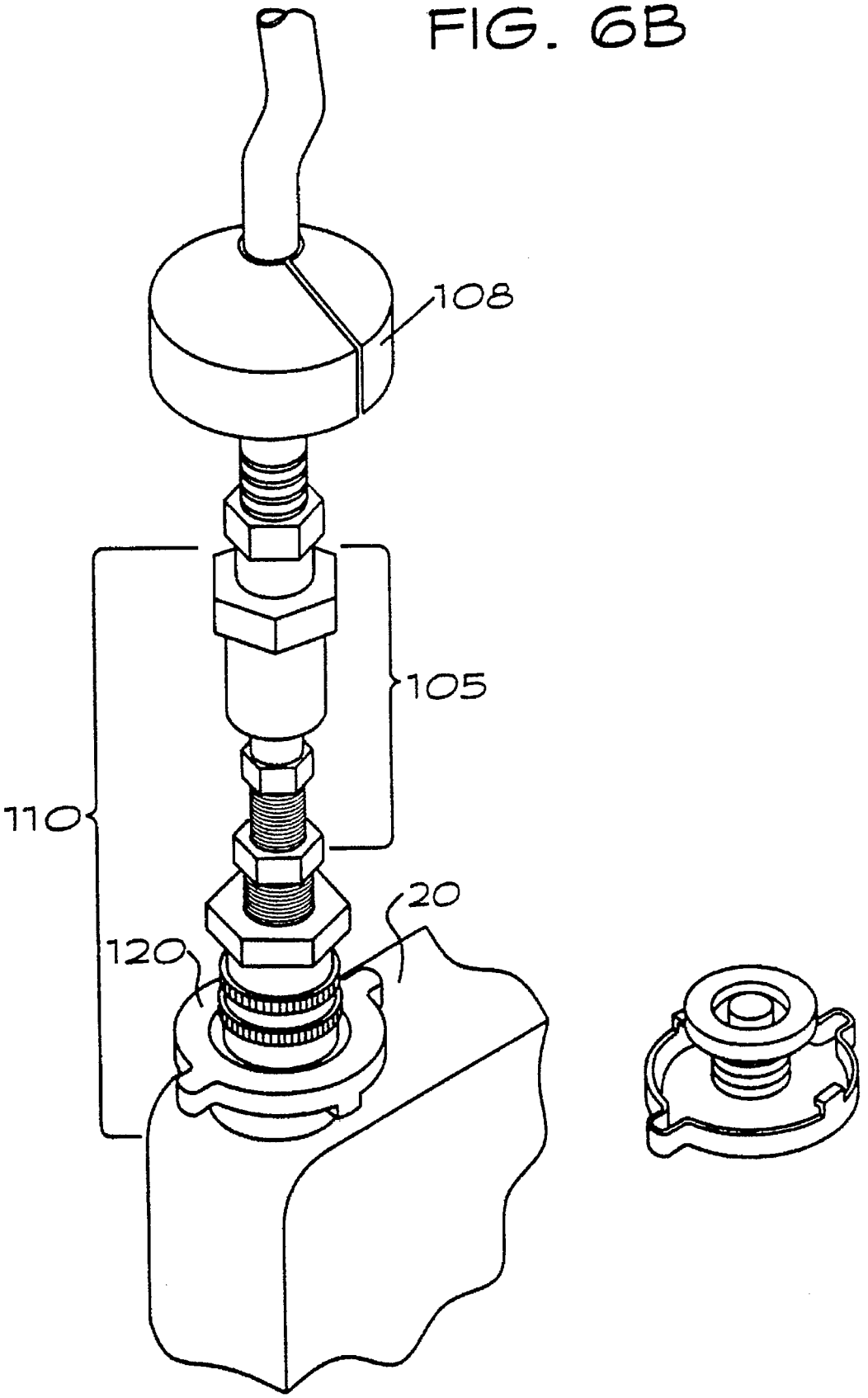

Referring also now to FIGS. 6A and 6B, there is shown the coolant removal attachment element 110 of FIGS. 5A and 5B in conjunction with an automotive cooling system radiator. In FIG. 6A, the cap to the radiator 20 has been taken off. The coolant removal attachment element 110 with its air line receiving element 105 is also displayed. Additionally, there is shown an outside air pressure source 108 for mating with the air line receiving element 105.

In FIG. 6B, the first connection unit 115 of the coolant removal attachment element 110 has been fitted to the radiator opening. The second connection unit, or air line receiving element 105, has been connected to the outside air pressure source 108. FIG. 6B shows the air line receiving element 105 mated with the outside air pressure source. Once again, the air pressure source 108 may be any known to those skilled in the art. The air pressure maybe pulsed or non-pulsed, but is preferably pulsed. The actual pressure of the air can vary, but should be high enough to facilitate drainage of the cooling system, and at the same time below enough to prevent any damage to the system's internal components. It is desirable to utilize low pressure air in the range of about 15 p.s.i. or less, more preferably within the range of about 8 to 12 p.s.i., and even more desirably about 10 p.s.i.

Once the outside air source 108 is connected to the air line receiving element 105 of the coolant removal attachment element in FIG. 6B, the "lowest vertical point" on the opposite side of the water pump (as shown in FIG. 1B and represented by drain point 55) is opened. If drain point 55 is the flush "T" device 60 of FIGS. 2A–C installed in the heater hose line 70, then the cap 80 to the flush "T" is removed. If no flush "T" has previously been installed in the heater hose line, then the heater hose connection (not shown) to the heater core is opened. The outside air pressure source is then activated and low pressure air flows from the source end through the air line receiving element to the inside of the radiator ("highest vertical point"). It is thus this air pressure which will move the antifreeze through the radiator, overflow bottle, engine and heater core members downward through the cooling system for exit through drain point 55 in the heater hose line 70. ("lowest vertical point"). The spent antifreeze can be collected in any suitable container. Once collected, the antifreeze is disposed of or can be recycled.

Once drainage of the used antifreeze is substantially complete, the air pressure from the outside source 108 is turned off. The cap 80 is then secured to the flush "T" 60 in the heater hose line 70, or the heater hose connection is then secured. The coolant removal attachment element 110 is removed from the radiator 20. The air line receiving element is detached from the outside air source. In another embodiment, the air line receiving element may be separated from the outside air source as well as from the coolant removal attachment element, end then the coolant removal attachment element may be detached from the radiator.

Figure 6C:
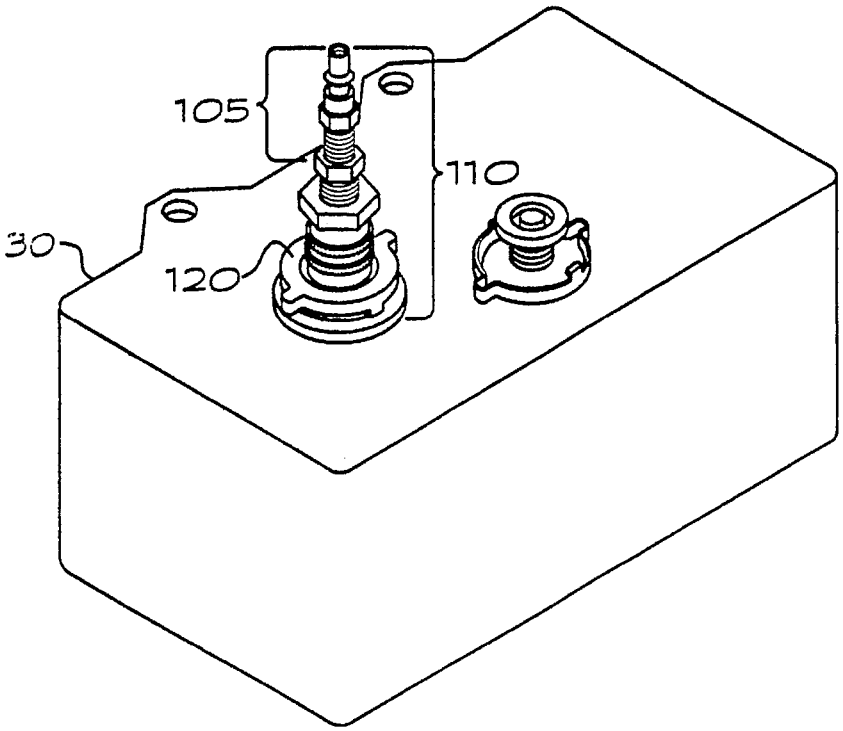
FIG. 6C is a plan view of the coolant removal attachment element of FIGS. 5A and 5B in conjunction with a pressurized overflow bottle.

Referring now to FIG. 6C, there is shown the second coolant removal attachment element 110 of FIGS. 5A and 5B seated over a pressurized overflow battle 30. This system is depicted in FIG. 1C wherein the pressurized overflow bottle 30 is considered to be the "highest vertical point". The procedure for coolant removal is substantially the same as that with the second coolant removal attachment element seated over the radiator neck, heretofore described. Drainage of spent antifreeze takes place through the draincock 25 of the radiator 20, the "lowest vertical point".

REFILL PROCEDURE

Also provided as part of the invention is a method of refilling an automotive cooling system which has been substantially drained of spent antifreeze. The method described herein may be used in conjunction with the heretofore outlined methods of coolant removal via either the heater hose which connects the engine and heater core members or may be used after coolant removal via the radiator. The method of refill according to the invention may also be utilized separately, after traditional methods of coolant removal such as gravity draining or water flushing have been used.

Also provided are novel devices to be utilized with the refill methods according to the various embodiments, hereinafter described.

Figure 7:
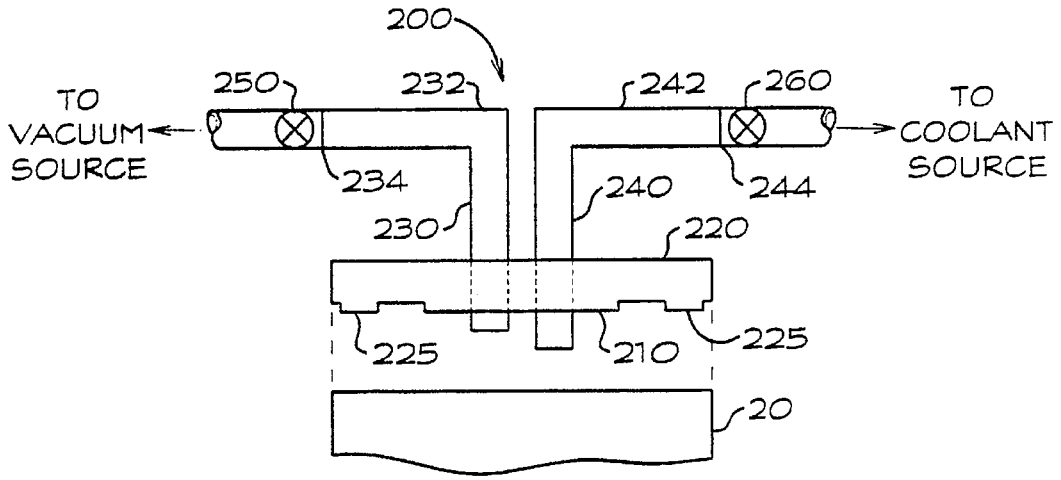
FIG. 7 is a two-dimensional diagrammatic representation of a coolant refill element according to one embodiments of the invention.

Referring now to FIG. 7, there is shown a refill element 200 in two-dimensional form as part of the method of refilling the cooling system with antifreeze according to the invention. The refill element 200 includes at least one mounting end or plug 210 for seating or plugging inside the top opening of the radiator neck to prevent leakage. A cap fixture 220 fits securely over the radiator opening to removably affix the entire refill element 200 over the radiator opening in place of the traditional radiator cap. An optional cap fixture lip 225, as part of the cap fixture 220, may aid in securing the cap fixture and thus securing the entire refill element 200 to the radiator neck. Those skilled in the art may find that other embodiments with the cap fixture, but without the mounting end or plug may be utilized as well. Likewise, it is also within the scope of the invention that the mounting end or plug be present without the cap fixture. Thus, if one means will serve to secure the refill element to the radiator neck during refill procedure, hereinafter described, then it is part of the invention that the other means be optional, or not present at all. It should also be noted that other designs for the mounting plug 210, cap fixture 220 and lip 225, including circumferential interior or exterior threading, which will facilitate placement of the refill element 200 over the radiator opening, are also possible and within the scope of the invention.

Rigidly affixed to the cap fixture 220 are vacuum and refill means, preferably a vacuum prong 230 and a refill prong 240. Both the vacuum prong 230 and the refill prong 240 have unobstructed access to the radiator through the cap fixture 220 and mounting plug 210. Thus, the interiors of the vacuum prong 230 and the refill prong 240 are preferably hollow or tubular in design. It is especially preferred that the vacuum prong 230 and the refill prong 240 not extend far downward into the interior of the radiator. It is especially preferred that the prongs 230.240 according to the various embodiments of the invention not extend downward past the radiator neck.

As part of the vacuum prong 230, there is a vacuum handle 232 which permits access to an outside source of vacuum (not shown via the vacuum handle's distal end 234. Likewise, the coolant prong 240 of the refill element 200 has a coolant handle 242 with a distal end 244 for accessing a source of coolant. In FIG. 7, the coolant handle 232 and the vacuum handle 242 extend in substantially opposite directions. This feature may aid the skilled artisan in not confusing one handle for the other, although other configurations and shapes for the handles 232.242 and the prongs 230.240 are certainly within the scope of the invention. It is also preferred that both the vacuum and coolant handles 232.242 be substantially parallel to the cap fixture 220. It is also within the scope of the invention that the vacuum and coolant prongs be substantially at right angles to each other, hereinafter described. Other orientations of the vacuum and coolant prongs are also part of the invention, including a single prong for both vacuum and coolant in at least one embodiment.

The vacuum handle 232 of the vacuum prong 230 is designed for connection to an outside vacuum source via the vacuum prong's distal end 234. The coolant prong 240, in turn, is connected via the distal end 244 of its coolant handle 242 to an outside source of fresh or recycled antifreeze coolant. Nonreactive tubing material maybe utilized to connect the distal ends 234.244 to the outside sources of vacuum and coolant, respectively.

While it is preferred that separate prongs exist on the refill valve for vacuum and coolant connections, it is also within the invention to have a single prong means as well. Other designs for the components of the refill element are also within the scope of the invention. The overall shape and dimensions of the refill element should facilitate its use in creating a vacuum in the cooling system and refilling the automotive cooling system with antifreeze.

Also optionally provided as part of the refill element 200 shown in FIG. 7 are a vacuum valve 250 and a coolant valve 260. While there are numerous possible designs and configurations for both the vacuum and coolant valves, it is preferred that both be two-way valves. As the name implies, a two-way refill valve has two positions, open and closed. The vacuum valve 250 may be rigidly affixed to the vacuum prong 230, and the coolant valve 260 may be rigidly affixed to the coolant prong 240. It is preferred, however, that the vacuum and coolant valves, 250 and 260 respectively, be located on the outside vacuum and coolant sources, respectively, such as tubing or other means which will attach to the distal ends 234, 244, respectively, of the vacuum handle 232 and coolant handle 242, respectively. The tubing in turn will access the outside vacuum and coolant sources, respectively.

In operation, the technician will close off the coolant valve 260, and open the vacuum valve 250 to thereby apply vacuum to the entire cooling system via the vacuum prong 230. After vacuum has been established, access to the vacuum prong is then secured or closed off by closing the vacuum valve 250. The coolant valve 260 is then opened to permit antifreeze to enter and refill the cooling system via the coolant prong 240. It is also within the scope of the invention to simultaneously open the vacuum valve 250 and the coolant valve 260. In this mode, the outside vacuum source will create vacuum in the cooling system, while the outside coolant source will supply fresh or recycled antifreeze to the cooling system.

After refill of the system is achieved, the entire refill element 200 is removed from the radiator opening and replaced with the traditional radiator cap. The outside sources of vacuum and coolant are then detached from the refill element 200.

It should be noted that the vacuum prong 230 and the coolant prong 240 in FIG. 7 may be designed to be substantially equivalent in operation and thus be interchangeable. The skilled artisan may then elect to utilize the vacuum prong as a coolant prong to supply coolant to the system, and vice versa. The labeling of the prongs in FIG. 7 is merely to provide guidance to the person skilled in the art.

Figure 8A:
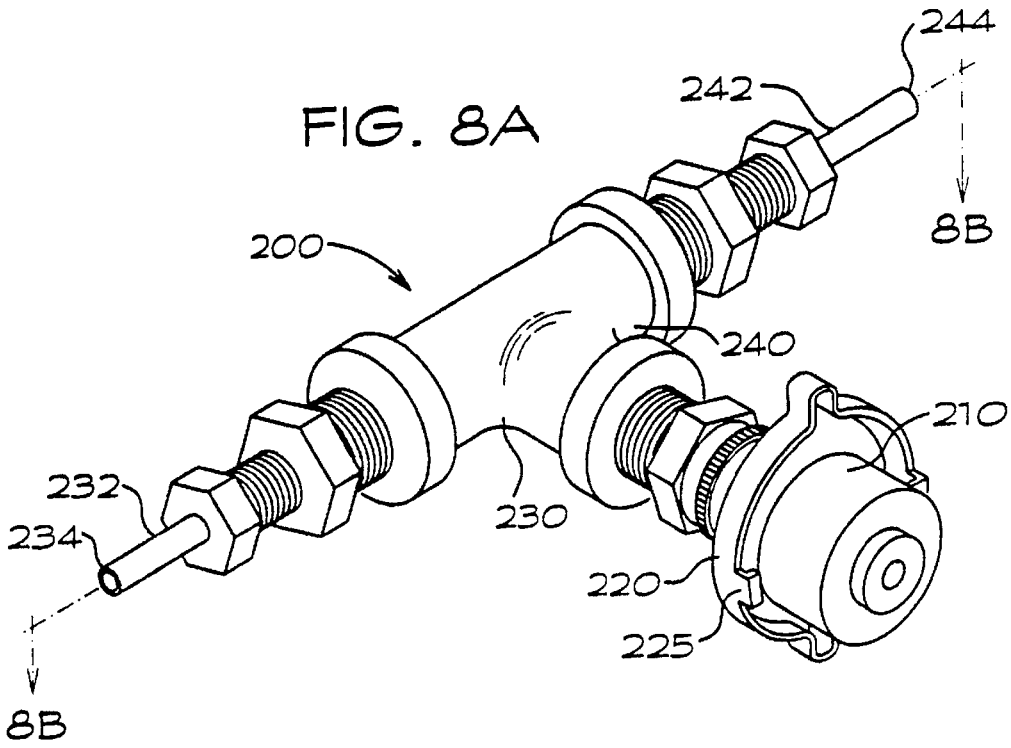
FIG. 8A is a plan view of an actual refill element represented in FIG. 7.
Figure 8B:
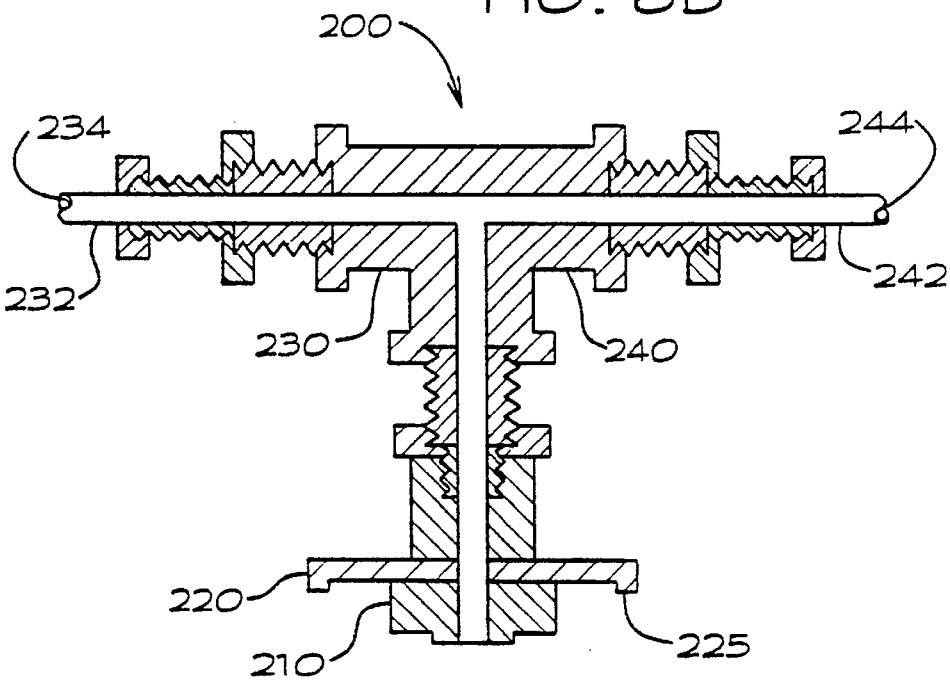
FIG. 8B is a cross-sectional view of the refill element of FIG. 8A along the line 8B.

Referring now to FIGS. 8A and 8B, there is shown a refill element 200 according to a preferred embodiment of the invention. This refill element has preferably been designed to be utilized for refilling antifreeze in the cooling system via the radiator. The refill element may be made from any durable material known in the art, for example, plastic or other synthetic polymer material, metal or metal alloy(s), rubber, or any combination thereof. Preferred are the yellow metals such as brass alloys, or ferrous metals, such as stainless steel. Especially preferred is plastic.

Shown in FIGS. 8 is the mounting end 210 of the refill element 200. This mounting end fits removably, yet securely in the radiator neck opening in place of the traditional radiator cap. The mounting end 210 may also be designed so that its external circumference will block the standard overflow connection (not shown) once the refill element 200 is seated over the radiator neck. As part of the male mounting end, there is also shown the cap fixture 220 which will seat over the radiator opening during the refill procedure to prevent any leakage. The mounting end 210 of the refill element is preferably made of a durable yet flexible material, such as synthetic rubber for example. The cap fixture is made from metal alloy 220.

Referring again to FIGS. 8, rigidly affixed to the refill element 200 are the vacuum prong 230 and the coolant prong 240. Extending in substantially opposite axial directions are the vacuum handle 232 and the coolant handle 242. The vacuum handle 232 of the vacuum prong 230 is connected to an outside vacuum source via the distal end 234. The coolant handle 242 is also connected via its distal end 244 to a source of fresh or recycled antifreeze. (Again, it should be noted that the vacuum prong 230 and the coolant prong 240 are designed to be equivalent so that the skilled artisan may elect to use either prong as the vacuum or coolant prong.)

Figure 9A:
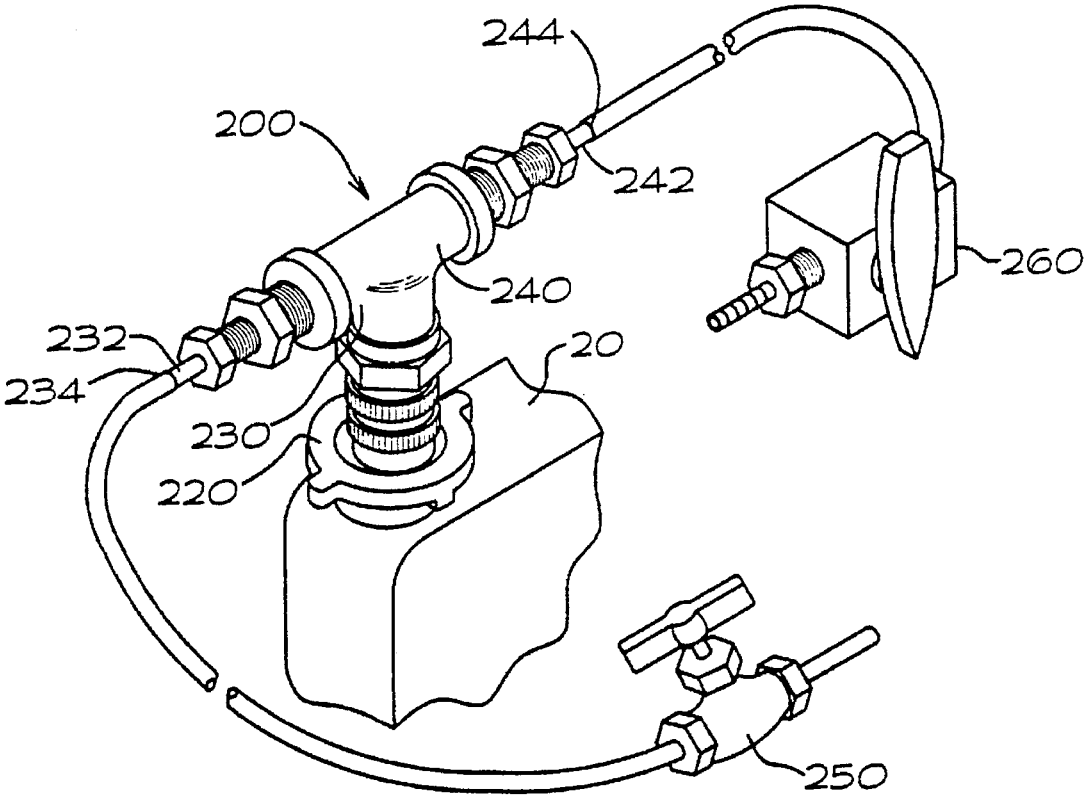
FIG. 9A is 8 plan view of the refill element of FIGS. 8A and 8B in conjunction with a radiator.

Referring now to FIG. 9A, there is shown the refill element 200 of FIGS. 8 according to a preferred embodiment of the invention. The refill element is visible over the radiator opening of the radiator neck in an exposed automotive cooling system. The cap fixture 220 of the refill element covers the radiator neck. At the distal end 234 of the vacuum handle 232 of the vacuum prong 230 extends a first hose connection. This first hose connection would be connected to a vacuum source (not shown). Shown on the first hose connection is the two-way vacuum valve 250.

Also in FIG. 9A, there is the distal end 244 of the coolant handle 242 of the coolant prong 240. Attached to the distal end 244 is a second hose connection. This second hose connection would be connected to a coolant source (not shown). The second hose connection also shows the coolant valve 260 to provide antifreeze to the cooling system via the coolant prong 240.

To refill the automotive cooling system with antifreeze, the entire cooling system is closed off. Those skilled in the art will find that this process of closing off the system will include, but is not limited to, securing the draincock at the bottom of the radiator, capping any flush "T" device contained within the heater hose line, as well as connecting any internal standard engine hoses.

Next, the entire closed cooling system is placed under vacuum. To place the system under vacuum the vacuum valve 250 is opened such that the vacuum source will have access to the cooling system via the first hose connection and then through the vacuum prong 230. The first hose connection, in turn, is connected to an air or water aspirator, steam jet, or electric pump (not shown) to produce the vacuum. The vacuum produced is within the range of about 5–30 inches Hg, and more preferably within the range of about 10–25 inches Hg. The cooling system is then evacuated. Once evacuation is substantially complete, the vacuum valve 250 on the first hose connection is secured, thereby closing off access to the cooling system via the vacuum prong 230. The ability to maintain vacuum is an indication of cooling system integrity, and therefore a desirable object of the invention.

The coolant valve 260 located on the second hose connection is then opened to allow antifreeze from an outside source to flow through the coolant prong 240 and into the cooling system. This antifreeze may be fresh or recycled, and may be mixed with other constituents, such as water. The antifreeze will move from the second hose connection, and then through the coolant prong 240 and enter the cooling system via the radiator neck. Once the cooling system is filled with antifreeze, the coolant valve 260 on the second hose connection is secured or closed to stop the flow of coolant to the cooling system. If the cooling system is not full, vacuum may be reapplied to the system through the vacuum prong 230 on the refill element 200.

Those skilled in the art will also find that the simultaneous application of vacuum and coolant can take place with good results. In other words, both the vacuum and coolant prongs may be accessed at the same time. In this mode, both the vacuum valve 250 and the coolant valve 260 are in the open position simultaneously. As vacuum is created via the vacuum prong 230, coolant will flow into the radiator via the coolant prong 240.

Once the cooling system is substantially full or no further refill is desired, the vacuum valve 250 and the coolant valve 260 are closed off. The first and second hose connections are then detached from the distal ends 234, 344 of the vacuum and coolant handles 232,242, respectively. The entire refill element is then lifted from the radiator neck. The cap securing the radiator is then placed over the radiator neck.

If desired, the engine is then started and operated until hot. The availability of heat in the cabin is verified. The engine is then turned off. An optional step may include "topping off" the radiator and overflow bottle with antifreeze by pouring, or other means.

The total time for refilling the cooling system should be within the range of about 30 minutes or less, preferably within about 15 minutes or less. In an especially desirable embodiment, refill time should be within about 5 to 7 minutes, or less. In all embodiments, the time for refill is measured from the point when the refill element is attached to the radiator (or pressurized overflow bottle, hereinafter described) until the time when the cooling system is substantially full, or when practicality necessitates no further addition of coolant to the system via the refill element. Thus, the skilled artisan may find that total time for refill will vary somewhat from the above times. In those embodiments where applicable, time for refill may not include refilling of the nonpressurized overflow bottle, which may be filled manually. Time for refill will also not include any "topping off" steps.

Figure 9B:
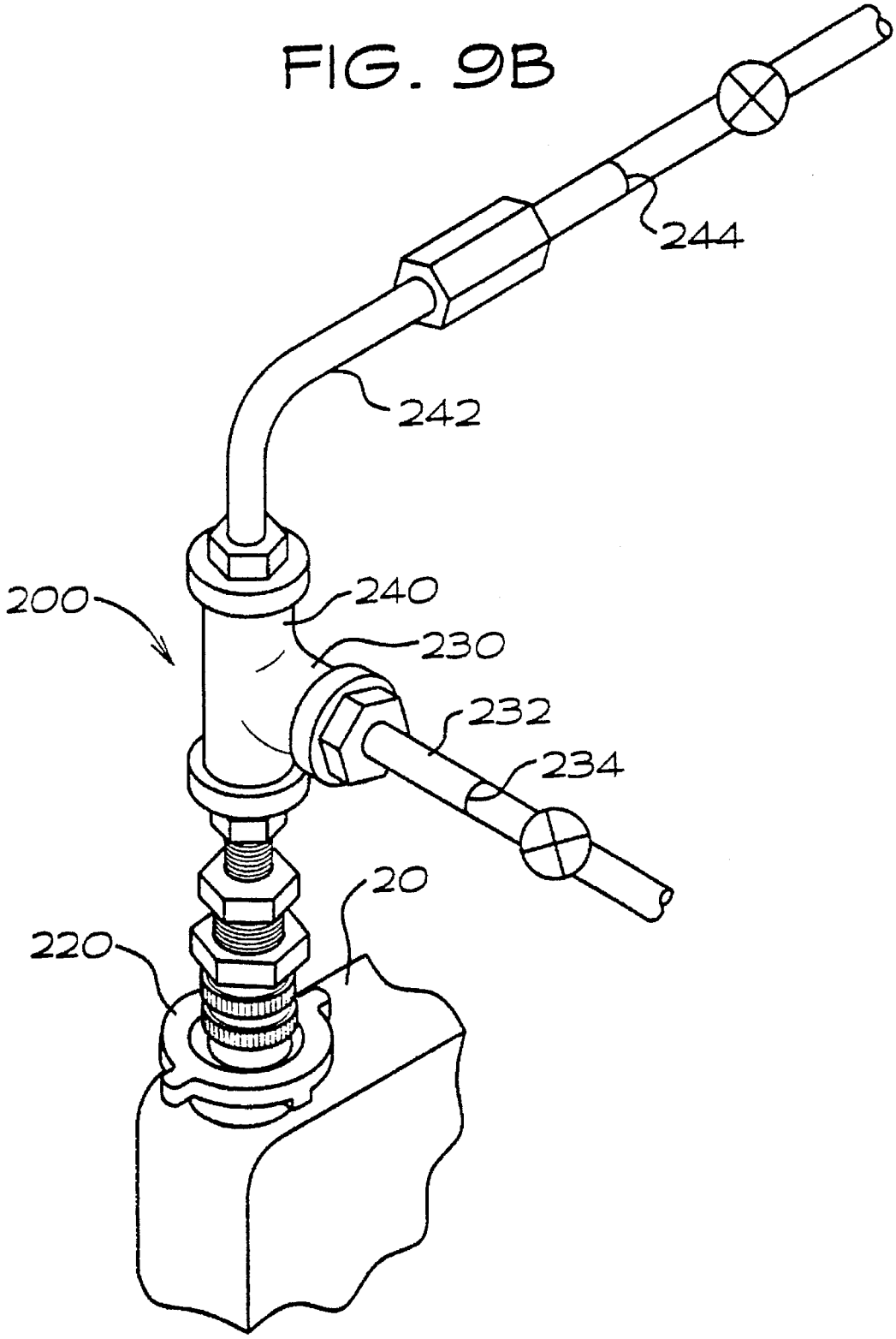
FIG. 9B is a plan view of the refill element according to another embodiment of the invention in conjunction with a radiator.
Figure 9C:
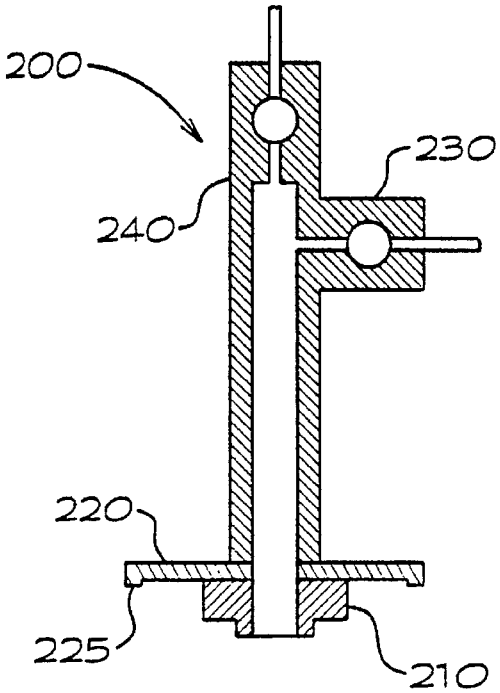
FIG. 9C is a cross-sectional view of the refill element shown in FIG. 9B.

Referring now to FIGS. 9B and 9C, there is shown the refill element 200 according to another embodiment of the invention. The refill element 200 is shown seated over the radiator. The refill element is similar in design and function to the refill element 200 set forth in FIGS. 8 and 9A. However, in this embodiment the vacuum prong 230 and the coolant prong 240 are at substantially right angles, with the vacuum prong substantially perpendicular to the longitudinal axis of the refill element, which extends from the cap fixture 220 through the vacuum prong 240. The method of refill utilizing the refill element is substantially the same as that for the refill element as part of FIGS. 8 and 9A. The prongs in FIGS. 9B and 9C may also be designed to be equivalent, so that the order of the prongs set forth above may be reversed.

Those skilled in the art will appreciate that the refill element 200 embodied in FIGS. 7, 8, 9A, 9B and 9C may also be adapted for refill of the cooling system via a pressurized overflow bottle. The procedure for refill will be substantially the same as that heretofore set forth for refill via the radiator neck, with the exception that the refill element 200 will be adapted to seat over the opening to the pressurized overflow bottle.

Figure 10C:
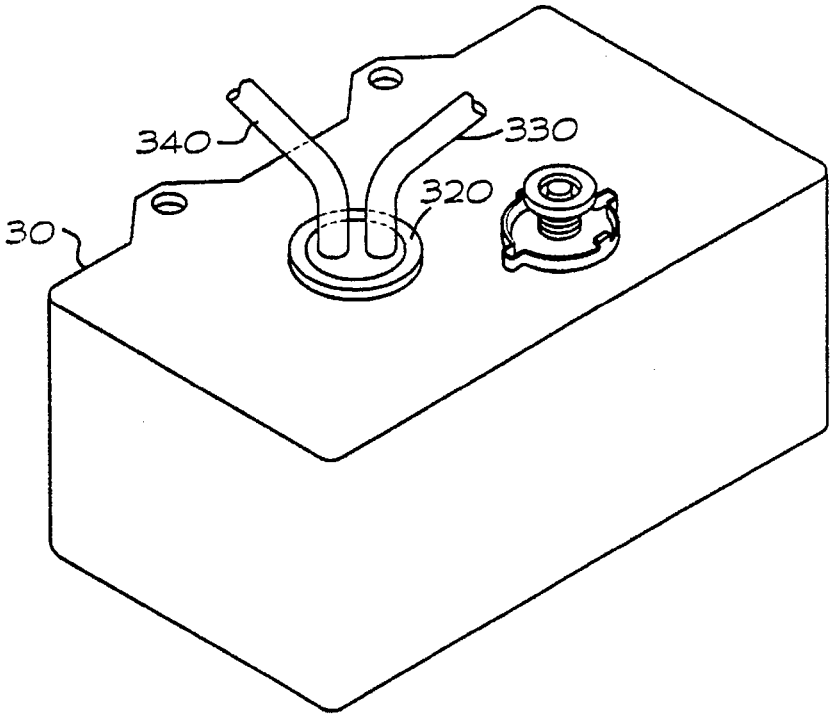
FIG. 10C is a plan view of the automotive refill element of FIG. 10A in conjunction with a pressurized overflow bottle.
Figure 10A:
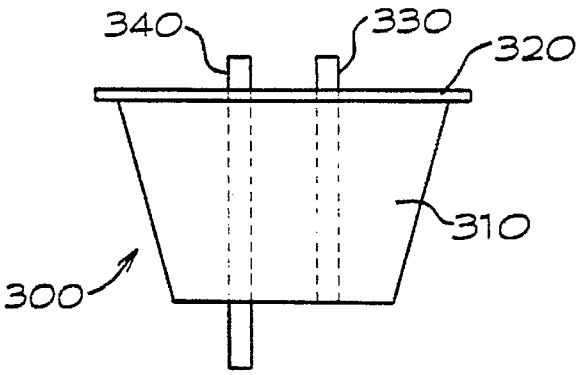
FIG. 10A is a two dimensional view of a automotive refill element according to another embodiment of the invention.
Figure 10A:
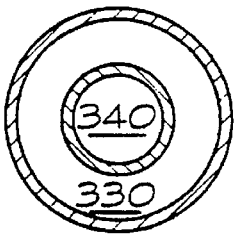
Figure 10A:
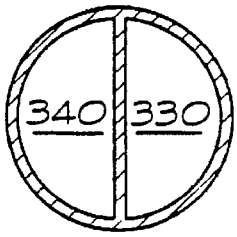

Referring now to FIG. 10A, there is shown a two-dimensional version of a refill element 300 according to an additional embodiment of the invention. The refill element 300 has a plug 310 for seating inside the radiator neck or pressurized overflow bottle. The plug may be of any shape which will facilitate its placement inside the radiator neck, but preferably, tapers downward as shown in FIG. 10A. The plug should fit snugly either inside the radiator neck or pressurized overflow bottle, and is preferably removably detachable therefrom. The plug may furthermore be constructed of any durable, nonreactive material known in the art, but is preferably made of rubber or similar synthetic material, or even plastic.

Circumferentially capping the top of the plug 310 is an optional stop ring 320. The circumference of the stop ring 320 is larger than the circumference of either the radiator opening or pressurized overflow bottle opening. In this way, the stop ring 320 will prevent the plug 310, and the entire refill element 300, from falling into the interior of the radiator or pressurized overflow bottle. The stop ring 320 is made from durable, nonreactive material, such as metal or metal alloy, with the yellow metals, such as brass, being preferred. Also preferred is plastic.

Extending the full axial length of the plug are at least one, and preferably at least two access tubes. There is shown in FIG. 10A a first access vacuum tube 330 and a second access coolant tube 340. The vacuum tube 330-serves as a conduit for vacuum to the interior of the cooling system. The coolant tube 340 is a conduit for coolant to the interior of the cooling system. The vacuum tube 330 and the coolant tube 340 maybe of the same or different material than the plug, but are preferably constructed of a durable, yet flexible material such as plastic or metal alloy which is unreactive with antifreeze. The vacuum and coolant tubes may b e rigidly or removably affixed to the plug, and are desirably rigidly affixed.

Both the vacuum tube 330 and the coolant tube 340 should not be flush with the top of the plug, but instead should extend upwards therefrom. This configuration will permit easy connection to outside sources of vacuum and coolant, respectively. The distance from the top of the plug to the top of either of the two access tubes should be not more than about 3 inches, preferably not more than about 2 inches, and even more preferably should be within the range of about ½–1½ inches.

The vacuum tube 330 is preferably flush with the bottom of the plug, but may extend slightly downward into the radiator or pressurized overflow bottle. The coolant tube 340 may also be flush with the bottom of the plug, but preferably extends slightly downward below the plane of the bottom of the plug to facilitate the addition of coolant. It is desirable that the coolant tube 340 not extend more than a few inches downward below the plane of the bottom of the plug, preferably not more than about 2 inches, and more preferably not more than about ¼, ½ or 1 inch.

Referring now to FIGS. 10B1 and 10B2, it is also possible to construct one access tube for both coolant and vacuum for use with the refill element 300 of FIG. 10A. FIG. 10B1 thus shows cross-sectional views of access tubes according to two embodiments of the invention. FIG. 10B1 shows a tube-in-tube design, while FIG. 10B2 shows a tubular side-by-side design.

Referring now to FIG. 10C, there is shown the refill element 300 of FIG. 10A. In FIG. 10C the refill element 300 is utilized to implement the coolant refill procedure via a pressurized overflow bottle, instead of via the radiator. The procedure is substantially the same as that heretofore described for refill via the radiator, except that the refill element 300 will seat in the opening to the pressurized overflow bottle. In FIG. 10C, the vacuum tube 330 of the plug 310 of the refill element 300 has been connected to an outside source of vacuum. The coolant tube 340 is hooked up to an outside source of coolant. Optional valve mechanisms would operate to access the vacuum and coolant sources. As heretofore set forth, vacuum may be applied first and coolant second, or may be applied simultaneously. Total time for refill is as previously set forth, but those skilled in the art should find that when the vacuum and coolant refill occur simultaneously, the time for refill should be faster.

Figure 11A:
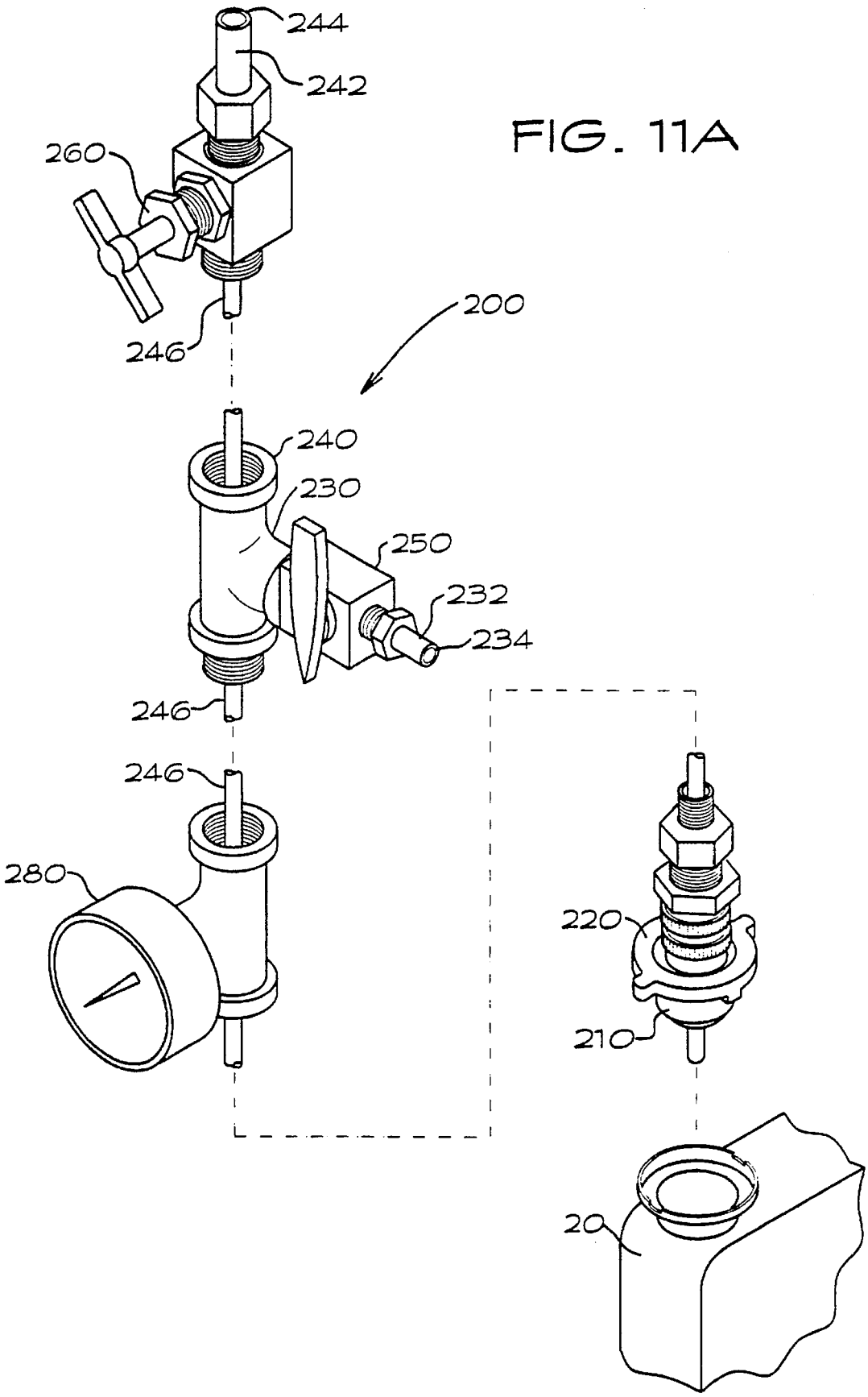
FIGS. 11A and 11B are plan views of a refill element according to another embodiment of the invention utilizing the tube-in-tube design shown in FIG. 10B1, in conjunction with a radiator.
Figure 11B:
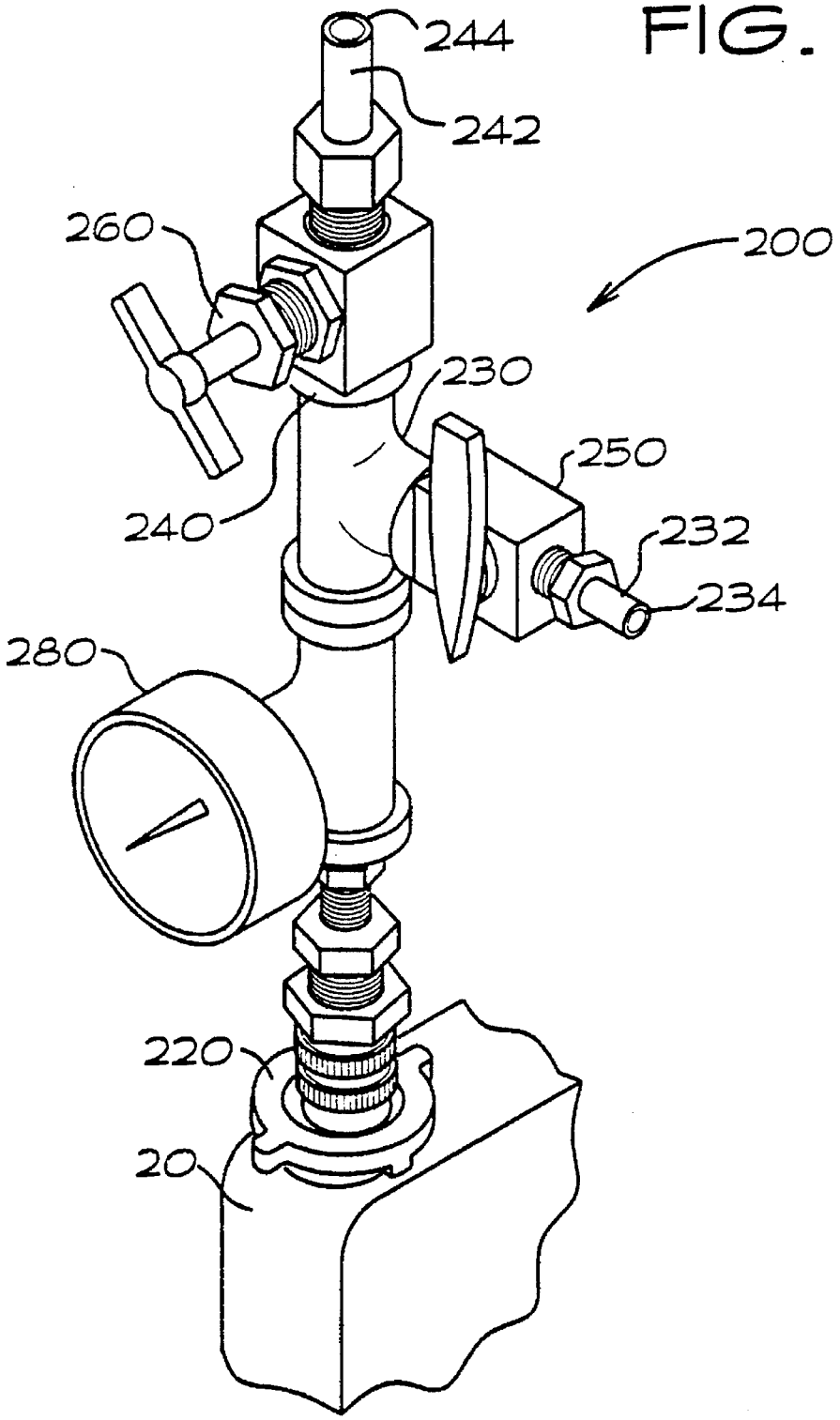
Figure 11C:
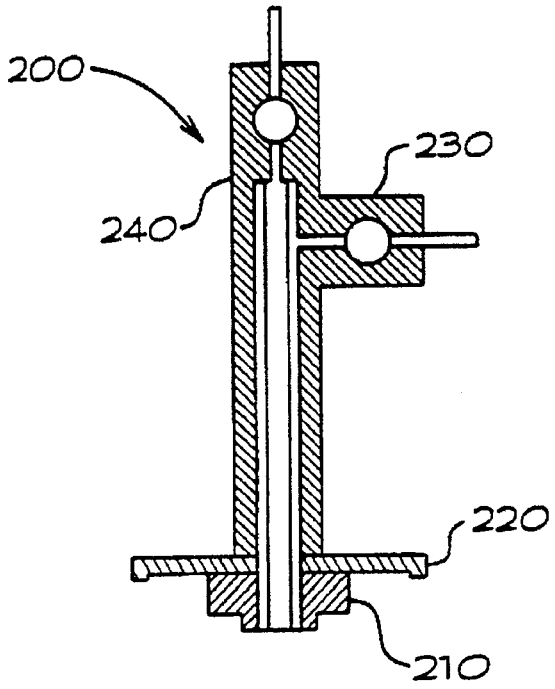
FIG. 11C is a cross-sectional view of the refill element shown in FIGS. 11A and 11B.

Referring now to FIGS. 11A, 11B and 11C, there is shown the refill element 200 according to another embodiment of the invention. The refill element of FIGS. 11A, B and C combines many of the features of the refill elements shown in FIGS. 8A and 8B, 9A, B and C, and 10A, B and C. In FIGS. 11A–C, the vacuum prong 230 is shown at substantially right angles to the coolant prong 240 (this feature is shown in FIGS. 9A, B and C). In FIG. 11B, the mounting end 210 of the refill element 200 is seated inside the radiator neck. This embodiment of the refill element 200 features the tube-in-tube design shown in FIG. 10B1 for the simultaneous application of vacuum and coolant to the cooling system. In this regard, a coolant tube 246 extends substantially the entire interior axial or longitudinal length of the refill element. This coolant tube is open beth at the coolant prong's distal end 244 and the cap fixture 220 and mounting plug 210 which seats over the radiator. The coolant enters through the distal end 244 and passes through the coolant tube 246 and enters the radiator. During this time, vacuum is drawn through the internal cavity which exists between the outer wall of the coolant tube 246 and the interior wall of the refill element. Also shown in FIGS. 11 is an optional vacuum gauge 280 mounted on the vacuum prong 230 of the refill element 200 which can be utilized to measure internal vacuum.

Operation of the refill element according to this embodiment is substantially the same as that heretofore described. The embodiment of FIGS. 11A, B, and C, with the tube-in-tube design of FIG. 10B1, is especially adaptable to the simultaneous application of vacuum and coolant to the cooling system. As with the other embodiments of the refill element 200, those skilled in the art may also find that the coolant prong can be interchangeable with the vacuum prong, and vice versa.

Figure 12:
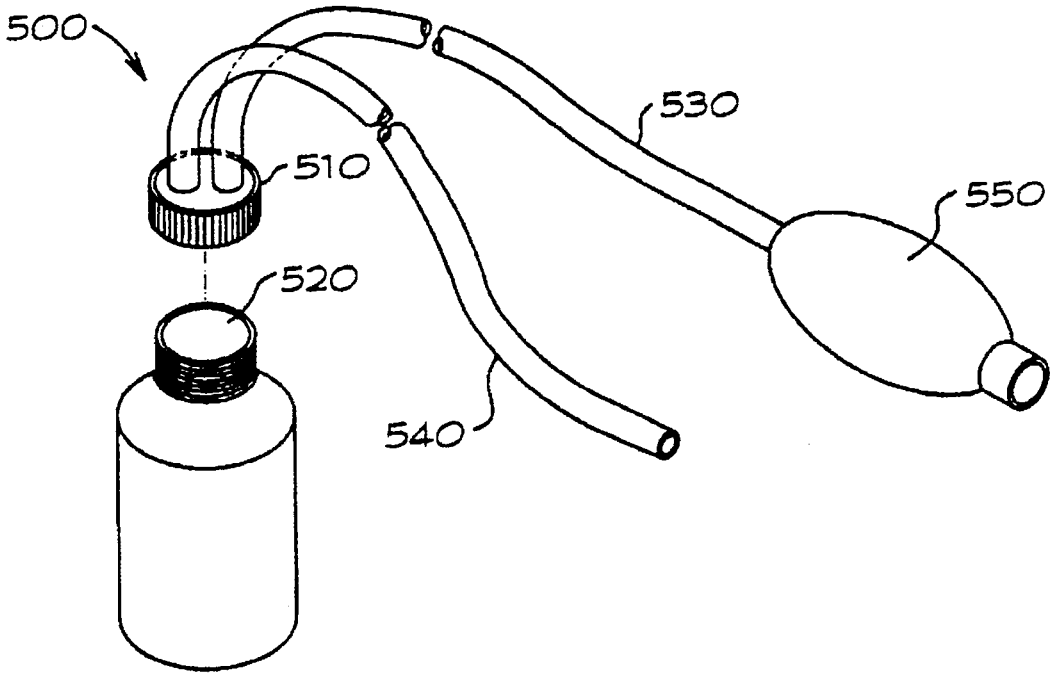
FIG. 12 is a plan view of a vacuum bottle for use with a nonpressurized overflow bottle.

Referring now to FIG. 12, there is shown a vacuum bottle 500 as part of the invention which is specially adapted for draining nonpressurized overflow bottles. The vacuum bottle maybe designed to hold anywhere from about ½–3 quarts of spent antifreeze, but preferably holds about 1–2 quarts. The material is any of the substantially nonreactive plastic polymer materials known in the art. A removable cap 510 fits over the top open mouth 520 of the vacuum bottle 500. The cap 510 may be screw-on or snap-on, or be of any other design which will facilitate its attachment to, and removal from the top open mouth 520. The cap 510 is fitted with a vacuum tube 530 and a coolant tube 540. Both the vacuum tube 530 and the coolant tube 540 may be detachably affixed to the cap 510, but are preferably rigidly affixed thereto. Both the vacuum tube 530 and the coolant tube 540 have access to the interior of the vacuum bottle 500. At the distal hand of the vacuum tube 530 is a squeeze pump 550.

To operate the vacuum bottle 500, the distal end of the coolant tube 540 is first inserted into the open nonpressurized overflow bottle. The coolant tube 540 will then contact the antifreeze inside the overflow battle. Hand pressure is then applied to the squeeze pump 550 by squeezing. A vacuum is then created, end coolant flows from the overflow bottle via the coolant tube 540 and into the interior of the vacuum bottle 500. When the vacuum bottle 500 is substantially full, the process is stopped. The coolant tube 540 is removed from the overflow bottle, and the spent antifreeze inside the vacuum bottle is disposed of or recycled.

Figure 13:
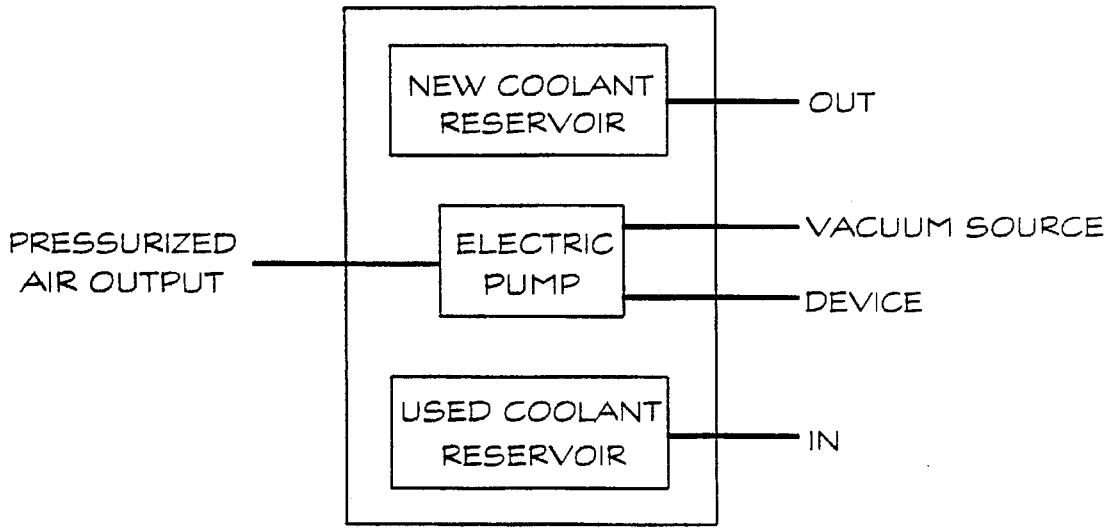
FIG. 13 is a two-dimensional diagram of a combined coolant removal and refill element according to another embodiment of the invention.

Referring now to FIG. 13, there is shown a schematic diagram of a substantially self-contained antifreeze drain and refill machine. The machine contains reservoirs for fresh and spent coolant. It also contains a source of air pressure and vacuum. In this embodiment, an electric pump is shown. Optionally, pumps for fluid handling could also be added. The device could store fresh and spent coolant. In lieu of storage, the machine could also facilitate transfer thereof among drums. Thus, it is within the scope of the invention to construct a complete unit which would plug into water, electric or air pressure lines, and include drainage and refill elements for draining and refilling the cooling systems of almost any automotive vehicle system.

The following examples, set forth methods of coolant removal and refill according to various embodiments of the invention. All examples provided herein are for purposes of illustration only, and should not be construed as limiting the scope of the invention:

EXAMPLE 1

For this example, a 1992 Mercury Grand Marquis equipped with a modular 4.6 liter, 8 cylinder engine, automatic transmission was obtained. The vehicle had 15,048 miles and a 14.1 quart capacity cooling system with a pressurized overflow bottle. The cooling system was as depicted in FIG. 1A. The coolant removal attachment element of FIGS. 3A and 3B was installed in the heater hose. Pulsed pressure was applied at this point, and spent antifreeze from the cooling system was expelled from an open radiator draincock. A total of 11.0 quarts was obtained in 15 minutes for an estimated 78% draining efficiency.

The radiator draincock was next closed and the coolant removal attachment element removed as well. The refill element shown in FIGS. 10A and 10C was installed at the opening to the pressurized overflow bottle. The cooling system was then placed under a vacuum of 23 inches Hg. The vacuum source was then isolated from the cooling system and coolant introduced into the vehicle's cooling system via the coolant prong. 11.0 quarts of antifreeze were returned to the system with one reapplication of vacuum. The engine was started and no air locks were observed.

This vehicle is considered difficult to drain and refill by skilled technicians. It is known to air lock with simple gravity refilling. The manufacturer has a recommended refill procedure to address this problem. It incorporates pressurized air to force coolant into the system and removing a heater hose to exhaust the air. This technique was also used, but with varying degrees of success in preparing several vehicles for a fleet test. Although this method did fill the system, airlocks were a concern.

The method according to a preferred embodiment of the invention was quicker, easier and eliminated airlocks.

EXAMPLE 2

In this example a 1990 Subaru Legacy L Wagon equipped with a 2.2 liter, 4 cylinder engine, 5 speed manual transmission was obtained. This vehicle had 34,576 miles and a 6.3 quart total cooling system capacity, including 1 quart in a nonpressurized overflow bottle. The cooling system was as depicted in FIG. 1A. There was a standard flush "T" in the heater hose line connecting the engine and heater core as shown in FIGS. 2A, 2B and 2C. The radiator draincock was opened and a TYGON® tube connected to it. The tube lead to a 1 gallon bottle. The flush "T" was replaced with the coolant removal attachment element as part of the invention in FIGS. 3A and 3B utilizing the air line receiving element, also shown in the aforementioned Figures. A hose to a pulsed air source was then hooked up to the air line receiving element. Pressurized air was then activated and the cooling system drained via the tygon tube. This procedure removed about 79% of the coolant from the system. (The overflow bottle remained full).

An air aspirator was then set up to provide a refill vacuum at the flush "T", which now replaced the coolant removal attachment element. The draincock was closed. A coolant and water mixture was charged from the radiator opening. An applied pressure of less than 5 p.s.i. to the aspirator refilled the system as quickly as it could be poured, in less than 1 minute. The vehicle was refilled three times. It was started twice following refill. On one occasion a minor air pocket formed at the flush "T" and greatly reduced cabin heat. It was easily eliminated by opening the flush "T" valve with the engine running. This was the last refill experiment of the three and a 0.26 quart top off was added to the radiator on that day and approximately 0.5 quarts to the overflow bottle the next day after 20 miles of travel. No leaks were found in the cooling system and no further additions were required. The refill efficiency was estimated at 90%. (This vehicle was prone to air pocket formation and typically was slow to refill without vacuum assistance.) This refill procedure demonstrates that it is possible to refill the cooling system via the flush "T" in the heater hose line.

EXAMPLE 3

A 1991 Mercury Topaz equipped with a 2.3 liter, 4 cylinder engine, air conditioning, automatic transmission, 11,540 miles and 7.8 quart cooling system with a nonpressurized overflow bottle was utilized for this example. The configuration of the cooling system is shown in FIG. 1B. The overflow bottle was drained using the vacuum device of FIG. 12. The radiator was drained by opening the radiator cap, draincock and bottom molded radiator hose. Approximately 4.7 quarts of liquid was obtained by simple draining. This represented a 60.4% yield.

Next, the bottom hose was reconnected. A flush "T" was installed in the heater hose and connected to a recovery container by tubing. A coolant removal attachment element of FIGS. 5A & 5B was then installed. After 10 minutes with 10 p.s.i. applied pressure another 1.8 quarts were obtained. This represented a 58% removal of the remaining liquid not removed by gravity draining. Overall efficiency was therefore about 83%.

The draincock was then closed. Vacuum was applied to the radiator fixture and coolant supplied to the flush "T" connection, which now replaced the coolant removal attachment element. The overflow bottle was filled separately. 6 quarts of liquid were returned to the system resulting in about 77% refill efficiency without starting the engine. This refill procedure again demonstrates that it is possible to refill the system via an installed flush "T" in the heater hose line.

EXAMPLE 4

This example further illustrates how the method and apparatus according to one embodiment of the invention can facilitate more complete coolant drainage, even after simple gravity drainage has taken place. A 1989 Ford F-150 truck equipped with a 4.9 liter, 6 cylinder engine, 5 speed manual transmission, 18,786 miles, a 13 quart cooling system with a nonpressurized overflow bottle was obtained. The cooling system was as depicted in FIG. 1A. A flush "T" had been inserted in the heater hose line. The radiator cap and draincock were opened and 8 quarts drained out. Approximately 16 ounces was removed from the overflow bottle. The result was a 65.4% draining efficiency with simple draining and no air pressure applied.

Next, air pressure was applied using the coolant removal attachment element shown in FIGS. 3A and 3B in the heater hose line. 3 additional quarts of fluid were flushed from the draincock. Elevating the rear of the vehicle did not increase fluid recovery. The application of air pressure allowed removal of 60% of the remaining engine fluid. Overall efficiency was 88.5%. The cooling system capacity was verified experimentally.

The cooling system was again refilled by applying vacuum to the flush "T" in the heater hose line. With the draincock closed, a coolant water mixture was charged through the radiator opening. When full, the flush "T" was removed, the engine started and the system topped off.

EXAMPLE 5

A 1990 Ford Aerostar equipped with a 4.0 liter, six cylinder engine, automatic transmission, 40,059 miles and 12.6 quart cooling system including a nonpressurized overflow bottle was utilized. A flush "T" was installed in place of the water control valve in the heater hose on the driver's side. From this opening, 3.8 quarts of cooling system liquid were obtained by simple draining. The coolant removal attachment element of FIGS. 5A and 5B was attached to the radiator neck and pressurized to 10 p.s.i. 9 quarts were collected in about 15 minutes. The pressure was then pulsed and another 1.5 quarts was removed. Since the overflow bottle was empty at the start of the experiment, the estimated efficiency of the draining procedure on this vehicle was 91.3%.

The flush "T" was removed and the heater control valve replaced. The refill element shown in FIGS. 8 was placed over the radiator neck. A 115 V, GAST Model P10-2-AA pump provided vacuum to the fitting. A trap was installed in the vacuum line to protect the pump. The cooling system was placed under 24 inches Hg. The vacuum source was disconnected and 8.5 quarts of prediluted coolant allowed to flow into the cooling system. The engine was started and the refill element removed. Another quart was immediately added to the radiator and no airlock was indicated by the presence of cabin heat. The thermostat opened after approximately 12 minutes and another quart was added and the radiator cap replaced. The cooling system was completely refilled in approximately 17 minutes.

This example illustrates removal and refill via the pressurized overflow bottle in a 1993 Dodge Intrepid with a 3.3 liter, 6 cyl. engine, automatic transmission, air conditioning, 17,192 miles, and 10 quart cooling system capacity with a pressurized overflow bottle. The radiator had a draincock, but not a radiator neck opening.

The cooling system was configured as shown in FIG. 1C. A coolant removal attachment element was attached to the pressurized overflow bottle as shown in FIG. 6C. The draincock was opened. 6 quarts (60%) were obtained by gravity draining. Pulsed pressure at 10 p.s.i. was applied to the coolant removal attachment element. Another 2 quarts was obtained.

Next, the draincock was closed. The refill element as shown in FIGS. 10A and 10C was fitted over the opening of the pressurized overflow bottle. A vacuum of 15 inches Hg was applied to the cooling system. A water aspirator was the source of vacuum. The vacuum was then isolated and the cooling system was charged (refilled). Vacuum was then reapplied to complete the refill. The engine was started and no air locks were observed. A top off was required due to slight spillage.

The drain procedure set forth above was again repeated. 7.5 quarts were obtained by gravity and 1 quart with pressure application. The material was then returned to the system without vacuum assistance as a negative control. Approximately 7 quarts were returned to the system. The engine was started and cabin heat was obtained. However, an air lock occurred. To eliminate the air lock, the thermostat housing drain was opened. After 15 minutes, the air lock was overcome. Approximately 1 quart was not returned to the system. This negative control illustrates that the method of refill according to a preferred embodiment of the invention was superior to that utilized without vacuum assistance.

The system was again drained by gravity at the draincock end 7 quarts was obtained. An additional quart was obtained by pressure application. The draincock was closed and the refill element of FIGS. 10A and 10C was attached to the pressurized overflow bottle. The entire coolant volume, 8 quarts, was returned to the cooling system. The bleed nipple on the thermostat housing was opened and vacuum applied to verify complete filling. The engine was started. No leaks or air locks were observed. The fluid was observed to be at the full hot level in the overflow bottle. The vehicle was then drive about 75 miles. The level remained unchanged at full hot. The next morning it was at the full cold mark prior to starting. Following 20 minutes of operation, the coolant level was at full hot. The dashboard coolant temperature gauge remained constant when at operating temperature. On this basis, it was concluded that the vehicle cooling system was properly and efficiently filled with antifreeze.

EXAMPLE 7

A 1989 Ford F-150, 4.9 liter 6 cylinder engine, 13 quart cooling system capacity, 5 speed manual transmission, 20,564 miles and nonpressurized overflow bottle was used for this Example. The cooling system was as depicted in FIG. 1A. 1 quart of coolant was obtained from the overflow bottle using the vacuum bottle of FIG. 12. Next the radiator draincock and cap were opened. By gravity draining, 7 quarts were removed. The radiator cap was replaced and a coolant removal attachment element was installed temporarily in the heater hose line. Pulsed pressure was applied and an additional 2.5 quarts were obtained. This represented 50% of the material remaining in the engine following gravity draining. Gravity draining resulted in about 61.5% coolant removal. With air pressure following gravity draining, 80.7% of the coolant was removed. This represented a 19% improvement.

Next, the refill element of FIG. 10A was installed on the radiator neck. The draincock was closed and the flush "T" assembly removed. A vacuum of 20 inches Hg was applied to the system. The vacuum was derived from a water aspirator. The vacuum gauge was then closed and the coolant supply valve opened. During refill the coolant hose drew air. Vacuum was reapplied and the system filled. The overflow bottle was manually refilled. The engine was started and the cabin heat verified. No air locks were observed.

EXAMPLE 8

A 1990 Subaru Legacy L sedan, 2.2 liter, 4 cylinder engine, 6.3 quart cooling system capacity, automatic transmission, air conditioning, 58,525 miles and a nonpressurized overflow bottle was utilized for this Example. The cooling system was as depicted in FIG. 1A. The overflow bottle was emptied using the vacuum bottle of FIG. 12. One quart was obtained. A flush "T" device as shown in FIGS. 2A, B and C had been installed in the heater hose line. The owner had requested a permanent installation. The flush "T" was converted to a coolant removal attachment element shown in FIGS. 4A, B end C. The draincock was opened and approximately 5 p.s.i. was applied to the system. 3.5 quarts of coolant was obtained. Gravity draining following this procedure was nonproductive. A 71.4% draining efficiency was estimated overall. Although gravity drain is preferred prior to pressure application, on this example the order was reversed. The draincock was then closed and the radiator cap replaced.

The refill element as shown in FIGS. 9B and 9C was attached to the radiator neck. A vacuum of 18 inches Hg was applied to the cooling system. The vacuum was then shut off and the coolant supply valve then opened. A second 16 inches of Hg application was required to fill the system. The overflow bottle was refilled manually. The engine was started, cabin heat was obtained and the system was verified full following operation later that day. No air locks were observed.

EXAMPLE 9

A 1991 Mercury Topaz with 2.3 liter 4 cylinder engine, automatic transmission, air conditioning, 15,071 miles, 7.8 quart cooling system and nonpressurized overflow bottle was used for this Example. The cooling system was depicted in FIG. 1B. The overflow bottle was emptied using the vacuum bottle device of FIG. 12. Approximately 0.5 quarts were recovered. The draincock was opened and the coolant was first gravity drained with the radiator cap off. The vehicle was elevated slightly to allow access underneath. 4 additional parts were obtained. The draincock was then closed. The coolant removal attachment element of FIGS. 5A and 5B was attached to the radiator neck. The heater hose line was disconnected to create the drain point. Approximately 5 p.s.i. pulsed air pressure was applied for 15 minutes. 1.5 quarts of coolant were obtained. This represented 46% of the coolant remaining in the engine. Overall, 77% draining efficiency was obtained.

Next, the heater hose line was reattached and clamped. The refill element of FIGS. 11A and 11B was attached. 19 inches of Hg was then applied to the cooling system, and the absence of leaks was verified. The coolant refill valve was then opened. The vacuum was supplied by a water aspirator. The vacuum valve was then turned off as the last quart of fluid was being drawn in. The overflow bottle was filled by hand. The refill element was then removed. The fluid level was in the radiator neck, indicating the system was full. The engine was started, cabin heat was directly obtained and no air locks occurred.

EXAMPLES—SUMMARY

The overall results of the efficiency of the drain and refill procedures according to the various embodiments of the invention are shown in TABLE 1.

TABLE 1

Data Summary

| Example | System Capacity Quarts | Gravity Drain % | Gravity + Pressure Drain % | Improvement % | Refill % | Overall Refill % |
|---|---|---|---|---|---|---|
| 1 | 13.6 | N/A | 78.0 | N/A | 100.0 | 100.0 |
| 2 | 6.3 | N/A | 79.0 | N/A | 100.0 | 100.0 |
| 3 | 7.8 | 60.4 | 83.3 | 23.3 | 92.0 | 100.0 |
| 4 | 13.0 | 65.4 | 88.5 | 23.1 | 75.0 | 100.0 |
| 5 | 12.6 | 30.2 | 91.3 | 61.1 | 85.0 | 100.0 |
| 6 | 10.0 | 68.3 | 81.7 | 13.3 | 100.0 | 100.0 |
| 7 | 13.0 | 61.5 | 80.7 | 19.2 | 90.5 | 100.0 |
| 8 | 6.3 | N/A | 71.4 | N/A | 77.8 | 100.0 |
| 9 | 7.8 | 57.8 | 76.9 | 19.2 | 91.7 | 100.0 |
| Average | 10.0 | 57.3 | 81.2 | 23.9 | 90.2 | 100.0 |

With reference to TABLE 1, system capacity refers to the number of quarts specified in the owners manual for cooling system volume. System capacity was experimentally verified for one vehicle using refractive index freeze point before and after dilution. It was assumed correct for the other vehicles.

Gravity drain is the amount of fluid removed from the cooling system by accessing the lowest vertical point and draining. It includes a contribution from nonpressurized overflow bottles in some cases. It reflects a baseline for likely coolant removal without special tools. Values should be considered typical. They could vary depending on the initial content, procedure and time.

Gravity+Pressure Drain represents the total fluid removed from the cooling system following the application of the coolant removal attachment element according to the various embodiments. In some cases, gravity drain was performed first. The numbers are representative and could vary depending on initial content of the cooling system procedure and time. It is thus within the scope of the invention to remove at least about 70%, more preferably at least about 75%, and even more desirably at least about 80% and as much as about 90% or more of the spent antifreeze from the cooling system utilizing the method and apparatuses of the invention. (Examples 3 and 9 show reproducibility for the same procedure on the same vehicle by the same technicians.)

Improvement indicates the difference between columns 3 and 4. This shows an average increase in fluid recovery of at least about 23.9% using the invention. This is a generalization. The exact liquid volume results vary with design. The approach can give at least about 61.1% improvement with an Aerostar yet only about 13.3% with a Dodge Intrepid. Three other examples gave at least about 20% improvement. It is certainly within the scope of the invention to obtain at least about 40% increase in improvement, and even more desirably about 50% increase in improvement.

Refill % represents the fraction of coolant returned to the vehicle using the refill element according to the various embodiments. The vehicle is not started and manual filling of nonpressurized overflow bottles is not accounted for. Therefore only vehicles with pressurized overflow bottles or whose overflow bottles were not drained manually will show 100%. Overall refill % includes engine starting and top off by hand. It is thus possible to obtain refill % in excess of abut 80%, and more desirably at least about 90% or more.

Examples 1and 5–9 were refilled by vacuum and fluid addition at a single access point. Examples 2–4 were refilled using separate fluid and vacuum application locations. Clearly both approaches work quite well, although the former is preferable.

Relying on efficiency alone is misleading. From TABLE 1 it can be concluded that the Dodge Intrepid only benefitted abut 13.3% from the procedure. However, air locks and incomplete filling were eliminated by using vacuum assisted refill. In these experiments, this vehicle had previously developed an air lock and could not be completely refilled in reasonable time. Further, applying vacuum allows for leak testing the cooling system. These benefits must also be considered. Thus, it is important to note that the method of refill according to the invention will have as an advantage the substantial reduction or elimination of air locks.

While the invention has been described in each of its preferred embodiments, it is expected that those skilled in the art may make certain modifications thereto without departing from its true spirit and scope as set forth in the specification and the accompanying claims.

What is claimed is:

1. A valveless coolant removal attachment device suitable for use in draining an automotive coolant reservoir of coolant using low air pressure without the aid of water, comprising:

a coolant removal attachment element defining a body having a first flow-through end and a second flow-through end in flow communication with an air receiving passage, and a detachable air line receiving element to receive low pressure air from a pressurized air supply source in a range of about 1 psig to about 15 psig, said detachable air line receiving element being removably attached to said first flow-through end, said air line receiving element providing an unrestricted flow of pressurized air from said air supply source through said air receiving passage of said coolant removal attachment element and into said coolant system;

means for removably connecting said air line receiving element to said coolant removal attachment element;

means for sealing having at least one orifice therethrough attached to said second flow-through end of said coolant removal attachment element, said means for sealing having an exterior surface being complementary sized and shaped for engaging the interior surface of the neck normal to the horizontal surface of a cap of a coolant reservoir forming a seal therewith providing flow communication with said coolant reservoir; and said coolant being removed from the lowest point of said engine coolant system selected from the group consisting of a heater hose line connecting the heater core and engine, a radiator draincock, a heater core, a hose connecting said engine and said radiator, and a heater hose connecting said heater core with said radiator and said engine for removing the coolant from the coolant system.

2. The coolant removal attachment device of claim 1, said coolant removal attachment element including a cap fixture member defining a generally flat body having an opening therethrough and a downwardly circumferentially extending flange forming a lip therearound, said lip including holding means extending perpendicular therefrom for cooperative engagement with a lip extending circumferentially around the neck of said coolant reservoir.

3. The coolant removal attachment device of claim 1, said means for sealing is a hollow cylindrical member comprising a flexible material.

4. The coolant removal attachment device of claim 1, said means for sealing comprises a first connection unit seating inside of said radiator neck extending less than about an inch into said radiator diameter.

5. The coolant removal attachment device of claim 1, said means for sealing comprising at least one hollow cylindrical member having at least a portion thereof extending downward from said radiator neck.

6. The coolant removal attachment device of claim 1, wherein said coolant reservoir is a radiator.

7. The coolant removal attachment device of claim 1. wherein said coolant reservoir is radiator overlfow bottle.

8. An overflow bottle coolant removal device interchangeable with said an overflow bottle cap, said coolant removal device being removably attached to an overflow bottle neck forming a seal therewith, said overflow cap adapter comprising:

a generally flat body having an opening therethrough and having a downwardly extending peripheral flange forming a lip therearound, said lip including holding means extending therefrom for securing said overflow bottle adapter to a flange extending around the periphery of said overflow bottle neck;

means for sealing comprising a cylindrical member extending axially downward from said flat body having an opening therethrough in flow communication with said flat body opening, said cylindrical member having an exterior surface being complementary sized and shaped for engaging the interior surface of said overflow bottle neck perpendicular to the horizontal surface of an overflow bottle cap; and a connector unit comprising a tubular member extending axially upward from said flat body in flow communication with said opening and an air or fluid source; and said coolant being removed from the lowest point of said engine coolant system, selected from the group consisting of a heater hose line connecting the heater core and engine, a radiator draincock, a heater core, a hose connecting said engine and said radiator, and a heater hose connecting said heater core with said radiator and said engine for removing the coolant from the coolant system.

9. The coolant removal device of claim 8, wherein said holding means extending from said lip comprises at least one projection in cooperative engagement with said flange extending around the periphery of said overflow bottle neck.

10. The coolant removal device of claim 8, said means for sealing defining a hollow cylindrical member comprising a flexible material.

11. The apparatus of claim 8, said means for sealing comprises a first connection unit seating inside of said radiator neck comprising a flexible material extending less than about an inch into said radiator.

12. The coolant removal device of claim 8, said means for sealing comprising at least one hollow cylindrical member having at least a portion thereof extending downward from said radiator neck.

13. Apparatus for use in changing coolant in the cooling system of a vehicle having an engine, a heater core, and a radiator with a radiator neck extending therefrom defining an opening therethrough and a flange around the outer periphery thereof and a radiator cap removably attached to said radiator neck said apparatus, comprising:

a radiator cap adapter interchangeable with said radiator cap, said radiator cap adapter being removably attached to said radiator neck, said radiator cap adapter comprising a generally flat body having an opening therethrough and having a downwardly extending peripheral flange forming a lip therearound, said lip including holding means extending therefrom for securing said radiator cap adapter to a flange extending around the periphery of said radiator neck, said radiator cap adapter including a first connector unit comprising a means for sealing defining a hollow cylindrical member extending axially downward therefrom in flow communication with said opening said means for sealing having an exterior surface being complementary sized and shaped for engaging the interior surface of the neck normal to the horizontal surface of a cap of a coolant reservoir forming a seal therewith providing flow communication with the coolant system;

said radiator cap adapter including a second connector unit comprising a tubular member extending axially upward therefrom in flow communication with said opening and an air or fluid source;

means in fluid communication with said tubular member adapted to convey vacuum, pressurized air, or pressurized liquid to said tubular member of said radiator cap adapter for removing or refilling coolant from the coolant system;

control means adapted to selectively direct fluid or air into said first conduit means for removing the coolant from the coolant system with air and refilling the coolant system with fresh coolant; and said coolant being removed from the lowest point of said engine coolant system selected from the group consisting of a heater hose line connecting the heater core and engine, a radiator draincock, a heater core, a hose connecting said engine and said radiator, and a heater hose connecting said heater core with said radiator and said engine for removing the coolant from the coolant system.

14. The apparatus of claim 13, wherein said control means adapted to selectively direct fluid or air into said first conduit means for removing the coolant from the coolant system with air and refilling the coolant system with fresh coolant comprises a two-way valve.

15. The apparatus of claim 13, said means for sealing defining a hollow cylindrical member comprising a flexible material.

* * * * *